US005512815A

United States Patent [19]

Schrader

[11] Patent Number: 5,512,815

[45] Date of Patent: Apr. 30, 1996

[54] CURRENT MIRROR CIRCUIT WITH CURRENT-COMPENSATED, HIGH IMPEDANCE OUTPUT

[75] Inventor: Victor P. Schrader, Palo Alto, Calif.

[73] Assignee: National Semiconductor Corporation, Santa Clara, Calif.

[21] Appl. No.: 239,995

[22] Filed: May 9, 1994

[51] Int. Cl.[6] ..... G05F 3/16

[52] U.S. Cl. ..... 323/315; 323/312

[58] Field of Search ..... 323/312, 315; 330/257, 288; 327/538, 544

[56] References Cited

U.S. PATENT DOCUMENTS

| | | | |
|---|---|---|---|
| 4,528,496 | 7/1985 | Naokawa et al. | 323/315 |
| 4,587,491 | 5/1986 | Koterasawa | 330/268 |
| 4,733,161 | 3/1988 | Kuwahara | 323/315 |
| 4,733,196 | 3/1988 | Menniti et al. | 330/288 |
| 5,157,322 | 10/1992 | Llewellyn | 323/315 |
| 5,347,210 | 9/1994 | Nguyen | 323/315 |
| 5,349,286 | 9/1994 | Marshall et al. | 323/315 |
| 5,394,079 | 2/1995 | Llewellyn | 323/315 |

OTHER PUBLICATIONS

Jacob Millman, Ph.D., "Microelectronics: Digital and Analog Circuits and Systems", McGraw–Hill Book Company, 1979, pp. 537–540.

George R. Wilson, "A Monolithic Junction FET–n–p–n Operational Amplifier", IEEE Journal of Solid–State Circuits, vol. SC–3, No. 4, Dec. 1968, pp. 341–348.

J. G. Holt, Jr., "A Two–Quadrant Analog Multiplier Integrated Circuit", Digest of Technical Papers for 1973 IEEE International Solid–State Circuits Conference, Feb. 16, 1973 (Session XIV: Monolithic Analog Circuits), pp. 180–181.

*Primary Examiner*—Matthew V. Nguyen
*Attorney, Agent, or Firm*—Limbach & Limbach

[57] ABSTRACT

A current mirror circuit includes four bipolar junction transistors. One transistor serves as an input device for conducting via its collector a majority of the reference current. Another transistor is connected as a compensation device, with its emitter connected to the base of the input device, its base connected to the collector of the input device for conducting a minority of the reference current, and its collector connected to conduct a portion of the output current. Two transistors are connected in cascode as output devices for conducting a portion of the output current. The first output device emitter and base are connected to the emitter and base, respectively, of the input device. The second output device emitter is connected to the collector of the first output device, while its base is connected to the collector of the input device for conducting another minority of the reference current and its collector is connected to the collector of the compensation device to conduct another portion of the output current.

28 Claims, 23 Drawing Sheets

Variable1:
I2 -Ch2
Log sweep
Start -1.000uA
Stop -1.000mA
Step LOG10

Constants:
V1 -Ch1 12.000V
V3 -Ch3 10.000V

ERROR (%) = ((I3-I2)/I2)*100

Variable1:
I2 -Ch2
Log sweep
Start -1.000uA
Stop -1.000mA
Step LOG10

Constants:
V1 -Ch1 12.000V
V3 -Ch3 10.000V

ERROR (%) = ((I3-I2)/I2)*100

CURRENT MIRROR CIRCUIT WITH CURRENT-COMPENSATED, HIGH IMPEDANCE OUTPUT

BACKGROUND OF THE INVENTION

1. Field of the Invention

The present invention relates to current sources, and in particular, to current mirror circuits.

2. Description of the Related Art

Current mirrors are often used, particularly in monolithic integrated circuits, to provide constant current sources. With such circuits, the output current $I_O$ will ideally be proportional (e.g. equal) to and track the input, or reference, current $I_R$, with such proportionality being maintained consistently over a wide range of reference current $I_R$ magnitudes. However, conventional current mirror circuits experience a number of problems in trying to maintain this proportionality of the output current $I_O$ to the reference current $I_R$. To varying degrees, the ability of conventional current mirrors to produce an output current $I_O$ that tracks the reference current $I_R$ is dependent upon the betas (β), i.e. base-to-collector current gains, of the transistors and the circuit current gain. The dependency upon the transistors' current gains is particularly problematic over a wide range of reference current $I_R$ magnitudes since the transistors' betas tend to vary.

Referring to FIG. 1, a conventional current mirror circuit includes two PNP transistors (FIG. 1A) or two NPN transistors (FIG. 1B) connected as shown. It can be shown that the current transfer characteristic for this type of current mirror circuit can be expressed as follows:

$$\frac{I_O}{I_R} = \frac{N}{1+\frac{(N+1)}{B}} = \frac{BN}{B+N+1} \qquad \text{Eq. (1)}$$

where:

N=circuit current gain

B=transistor base-to-collector current gain ("β")

Referring to FIG. 2, another conventional current mirror circuit, commonly referred to as a cascode output current mirror, includes three PNP transistors (FIG. 2A) or three NPN transistors (FIG. 2B), and a diode, connected as shown. As can be shown, the current transfer characteristic for this circuit can be expressed as follows:

$$\frac{I_O}{I_R} = \frac{B^2}{B^2+3B+1} \qquad \text{Eq. (2)}$$

where:

Circuit current gain (N)=1

Referring to FIG. 3, another conventional current mirror circuit, commonly referred to as a "super diode" current mirror, includes three PNP transistors (FIG. 3A) or three NPN transistors (FIG. 3B) connected as shown. As can be shown, the current transfer characteristic for this circuit can be expressed as follows:

$$\frac{I_O}{I_R} = \frac{N}{1+\frac{(N+1)}{B(B+1)}} = \frac{NB(B+1)}{B(B+1)+N+1} \qquad \text{Eq. (3)}$$

Referring to FIG. 4, another conventional current mirror circuit, commonly referred to as a cascode output, "super diode" current mirror, includes four PNP transistors (FIG. 4A) or four NPN transistors (FIG. 4B) connected as shown. As can be shown, the current transfer characteristic for this circuit can be expressed as follows:

$$\frac{I_O}{I_R} = \frac{B^2(B_3+1)}{B^2(B_3+1)+B(2B_3+4)+2} \qquad \text{Eq. (4)}$$

where:

Circuit current gain (N)=1

$B_M$=transistor base-to-collector current gain ("β") of transistor $Q_{MP}$ (or $Q_{MN}$)

$M \in \{1,2,3,4\}$ $B=B_1=B_2=B_4$

Referring to FIG. 5, another conventional current mirror circuit, commonly referred to as a "Wilson" current mirror, includes three PNP transistors (FIG. 5A) or three NPN transistors (FIG. 5B) connected as shown. As can be shown, the current transfer characteristic for this circuit, which typically has a current gain of unity, can be expressed as follows:

$$\frac{I_O}{I_R} = \frac{B^2+2B}{B^2+2B+2} \qquad \text{Eq. (5)}$$

Referring to FIG. 6, another conventional current mirror circuit, commonly referred to as a modified "Wilson" current mirror, includes six PNP transistors (FIG. 6A) or six NPN transistors (FIG. 6B) connected as shown. While this circuit offers high output impedance (due to its cascode output), and some compensation for variations among the current gains (βs) of the transistors, it nonetheless suffers from the same errors caused by significant reductions in the transistors' current gains (βs) at high collector current levels. (Further discussion concerning this circuit can be found in J. G. Holt, Jr., "A Two-Quadrant Analog Multiplier Integrated Circuit", 1973 IEEE International Solid-State Circuits Conference Digest of Technical Papers, at page 181, the disclosure of which is incorporated herein by reference.)

Further discussion of some of these and other conventional current mirror circuits can be found in U.S. Pat. No. 4,528,496, the disclosure of which is incorporated herein by reference.

SUMMARY OF THE INVENTION

A current mirror circuit in accordance with a preferred embodiment of the present invention includes four bipolar junction transistors. The first transistor emitter is coupled to a shared node (e.g. circuit ground or a power supply) while its collector is coupled to a reference node for conducting a reference current. The second transistor emitter is also coupled to the shared node while its base is coupled to the first transistor base. The third transistor emitter is coupled to the second transistor collector while its base is also coupled to the reference node and its collector is for conducting a first output current. The fourth transistor emitter is coupled to the second transistor base while its base is also coupled to the reference node and its collector is for conducting a second output current. The sum of the two output currents is selectively proportional (e.g. equal) to the reference current.

A current mirror circuit in accordance with an alternative preferred embodiment of the present invention includes two single-emitter and one multiple-emitter bipolar junction transistors. The first transistor emitter is coupled to a shared node (e.g. circuit ground or a power supply) while its collector is coupled to a reference node for conducting a reference current. The second transistor emitter is also coupled to the shared node while its base is coupled to the first transistor base. The third transistor has one emitter which is coupled to the second transistor collector and a second emitter which is coupled to the second transistor base, while its base is also coupled to the reference node and its collector is for conducting an output current which is selectively proportional (e.g. equal) to the reference current.

A current mirror circuit in accordance with a further alternative preferred embodiment of the present invention includes an input transistor, the emitter of which is coupled to a shared node (e.g. circuit ground or a power supply) while its collector is coupled to a reference node for conducting a reference current. It further includes multiple output device groups for conducting multiple load currents, one of which is selectively proportional to the reference current and another of which is approximately proportional to the reference current.

One output device group includes: a first output transistor, the emitter of which is coupled to the shared node while its base is coupled to the input transistor base; a second output transistor, the emitter of which is coupled to the first output transistor collector while its base is coupled to the reference node and its collector is for conducting an output current; and a third output transistor, the emitter of which is coupled to the first output transistor base while its base is coupled to the reference node and its collector is for conducting a compensation current. The sum of the compensation current and the output current provides a load current which is selectively proportional to the reference current.

Another output device group includes: a fourth output transistor, the emitter of which is coupled to said shared node while its base is coupled to the input transistor base; and a fifth output transistor, the emitter of which is coupled to the fourth output transistor collector while its base is coupled to the reference node and its collector is for conducting a load current which is approximately proportional to the reference current.

A current mirror circuit in accordance with a still further alternative preferred embodiment of the present invention includes an input transistor, the emitter of which is coupled to a shared node (e.g. circuit ground or a power supply) while its collector is coupled to a reference node for conducting a reference current. It further includes multiple output device groups for conducting multiple load currents, one of which is selectively proportional to the reference current and another of which is approximately proportional to the reference current.

One output device group includes: a single-emitter output transistor, the emitter of which is coupled to the shared node while its base is coupled to the input transistor base; and a multiple-emitter output transistor, one emitter of which is coupled to the first output transistor collector while another emitter is coupled to the first output transistor base, and the base of which is coupled to the reference node while its collector is for conducting an output current. The output current provides a load current which is selectively proportional to the reference current.

Another output device group includes: a third output transistor, the emitter of which is coupled to the shared node while its base is coupled to the input transistor base; and a fourth output transistor, the emitter of which is coupled to the third output transistor collector while its base is coupled to the reference node and its collector is for conducting a load current which is approximately proportional to the reference current.

These and other features and advantages of the present invention will be understood upon consideration of the following detailed description of the invention and the accompanying drawings.

DETAILED DESCRIPTION OF THE INVENTION

FIGS. 7A, 8A, 9A, 10A and 11A are schematics of current mirror circuits in accordance with a preferred embodiment of the present invention using PNP bipolar junction transistors. FIGS. 7B, 8B, 9B, 10B and 11B are schematics of current mirror circuits in accordance with a preferred embodiment of the present invention using NPN bipolar junction transistors. The following discussion focuses primarily upon the PNP embodiments. However, in accordance with circuit principles well known in the art, the principles and operation of the corresponding NPN embodiments should be recognized and understood. In accordance with such circuit principles, corresponding transistors for the PNP and NPN embodiments have been labeled to include "P" and "N" trailing subscripts, respectively. Further, the figures and discussion herein refer to current flow in accordance with "conventional" current principles, i.e. current flow from positive to negative. However, it should be understood that the invention can also be described by referring to current flow in terms of "electron" current, i.e. current flow from negative to positive. Accordingly, the following example would express two equivalent situations: in terms of "conventional" current, an identified node can receive two currents and provide one current, while in terms of "electron" current, the identified node would instead receive one current and provide two currents. Therefore, in the discussion herein, merely identifying the "direction" of current flow does not necessarily imply any specific "input-versus-output" relationships. In other words, simply because one current is described as an "input" current while another is described as an "output" current, the so-called "input" current should not necessarily be considered the "cause" with the so-called "output" current being the "effect" thereof. Rather, due to the duality of "conventional" and "electron" current principles, such "input-versus-output" and "cause-and-effect" relationships should be determined according to well known circuit principles.

Figure 7B:
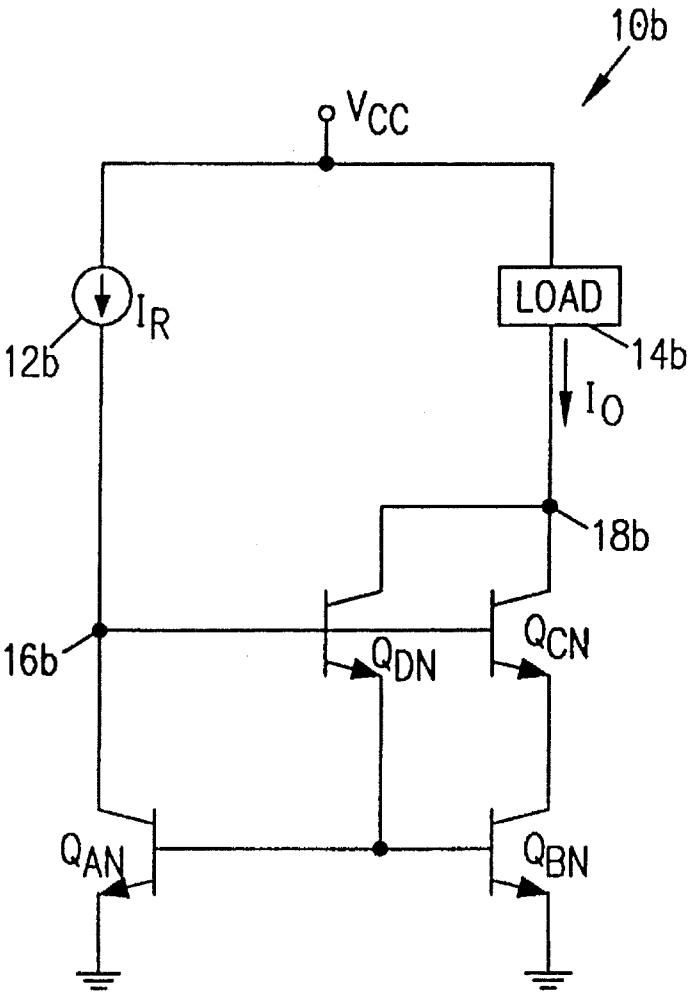
FIGS. 7A and 7B contain schematics of PNP and NPN current mirror circuits, respectively, in accordance with a preferred embodiment of the present invention.
Figure 7A:
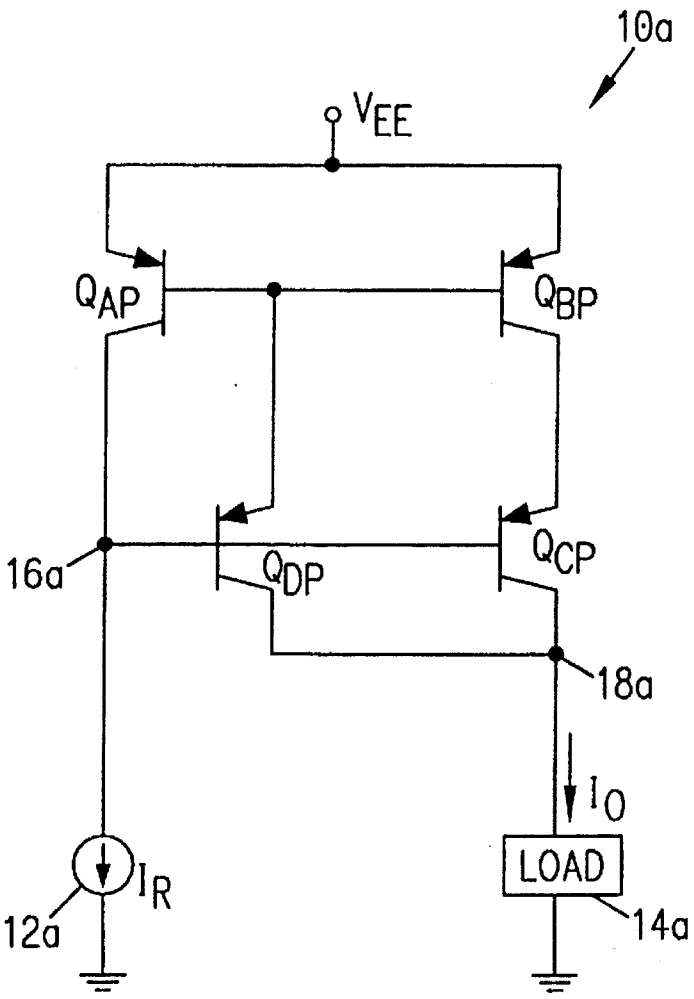

Referring to FIG. 7A, a current mirror circuit 10*a* in accordance with a preferred embodiment of the present invention includes four PNP bipolar junction transistors: input transistor $Q_{AP}$; output transistors $Q_{BP}$ and $Q_{CP}$; and compensation transistor $Q_{DP}$. As shown, the emitters of transistors $Q_{AP}$ and $Q_{BP}$ are coupled to a shared node, in this case the power supply $V_{EE}$, while their bases are coupled to one another. The emitter of transistor $Q_{CP}$ is coupled to the collector of transistor $Q_{BP}$, while its base is coupled to the collector of $Q_{Ap}$. The emitter of transistor $Q_{DP}$ is coupled to the base of transistor $Q_{AP}$, while its base is coupled to the collector of transistor $Q_{AP}$ and its collector is coupled to the collector of transistor $Q_{CP}$.

A reference current source 12*a* provides a reference current $I_R$ as an input current which is duplicated, or "mirrored," proportionately (e.g. equally) as an output current $I_O$ for delivery to a load 14*a*. The circuit node 16*a* formed by the connection of the transistor $Q_{AP}$ collector, $Q_{DP}$ base and $Q_{CP}$ base serves as a "reference" node in that it conducts the reference current $I_R$ of the current source 12*a*. As shown, transistors $Q_{BP}$ and $Q_{CP}$ are connected in cascode, and since the circuit node 18*a* formed by the connection of the transistors $Q_{CP}$ and $Q_{DP}$ collectors serves as the output port or terminal for providing the output current $I_O$ to the load 14*a*, a high output impedance exists.

With this circuit topology, compensation transistor $Q_{DP}$ provides base current compensation for output transistor $Q_{CP}$. Assuming that all of the transistors are operating in their forward active regions, transistors $Q_A$ and $Q_B$ are matched (and therefore their collector currents are equal [i.e. $I_C=I_{CA}=I_{CB}$]), and the current gains of transistors $Q_A$, $Q_B$ and $Q_C$ are all equal to one another (i.e. $\beta=\beta_A=\beta_B=\beta_C$), then the current transfer characteristic $I_O/I_R$ can be shown to be as follows:

$$\frac{I_O}{I_R}=\frac{\beta^2(\beta_D+1)+2\beta_D(\beta+1)}{\beta(\beta+2)(\beta_D+1)+2(\beta+1)} \qquad \text{Eq. (6)}$$

Further assuming that the current transfer characteristic $I_O/I_R$ is unity, i.e. that $I_O=I_R$, then it can be shown further that the relationship between the current gain $\beta_D$ of the compensation transistor $Q_D$ and those $\beta_A$, $\beta_B$, $\beta_C$ (=β) of the other transistors $Q_A$, $Q_B$, $Q_C$ is as follows:

$$\beta_D=2\beta+1 \qquad \text{Eq. (7)}$$

(As discussed further below in connection with FIG. 14B, this shows the point (i.e. for the corresponding value of the reference current $I_R$) where the error curve (%) passes through zero beyond the error peak.)

Figure 8B:
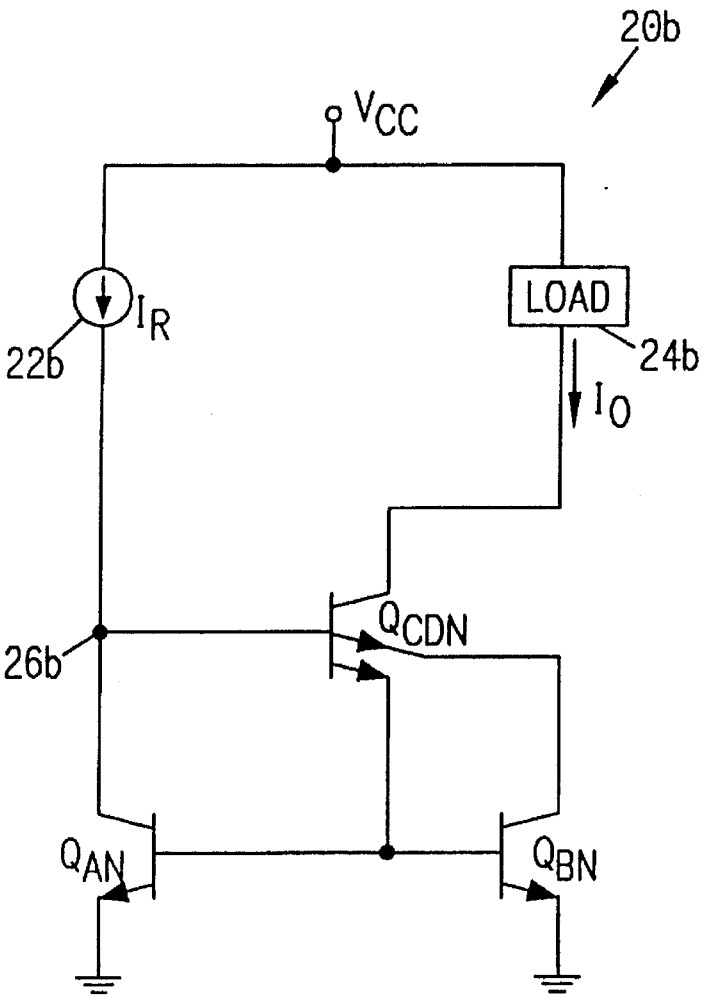
FIGS. 8A and 8B contain schematics of PNP and NPN current mirror circuits, respectively, in accordance with an alternative preferred embodiment of the present invention.
Figure 8A:
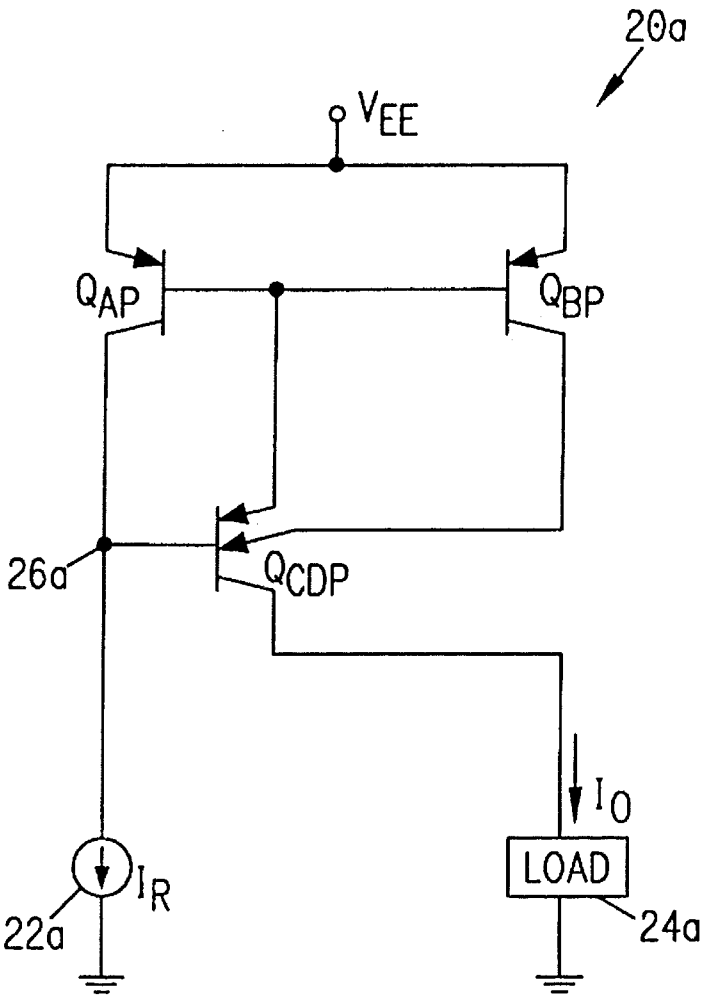

Referring to FIG. 8A, a current mirror circuit 20*a* in accordance with an alternative preferred embodiment of the present invention includes three PNP bipolar junction transistors: single-emitter input transistor $Q_{AP}$ and output transistor $Q_{BP}$; and a multiple-emitter compensated output transistor $Q_{CDP}$. As in the circuit of FIG. 7A, a reference current source 22*a* provides a reference current $I_R$ which is mirrored as an output current $I_O$ for delivery to a load 24*a*.

In this circuit 20*a*, the emitters of transistors $Q_{AP}$ and $Q_{BP}$ are coupled to a shared node, i.e. the power supply $V_{EE}$ node, while their bases are mutually coupled. One emitter of transistor $Q_{CDP}$ is coupled to the collector of transistor $Q_{BP}$, while the other emitter is coupled to the base of transistor $Q_{AP}$. The base of transistor $Q_{CDP}$ is coupled to the collector of transistor $Q_{AP}$, while its collector provides the output current $I_O$ for delivery to the load 24*a*. The node 26*a* formed by the connection of the transistor $Q_{AP}$ collector and transistor $Q_{CDP}$ base forms the reference node through which the reference current $I_R$ flows.

Similar to the circuit of FIG. 7A, transistor $Q_{CDP}$ provides base current compensation, and the current transfer characteristic $I_O/I_R$ can be analyzed and shown to be as expressed in Equation (6) above.

Figure 9A:
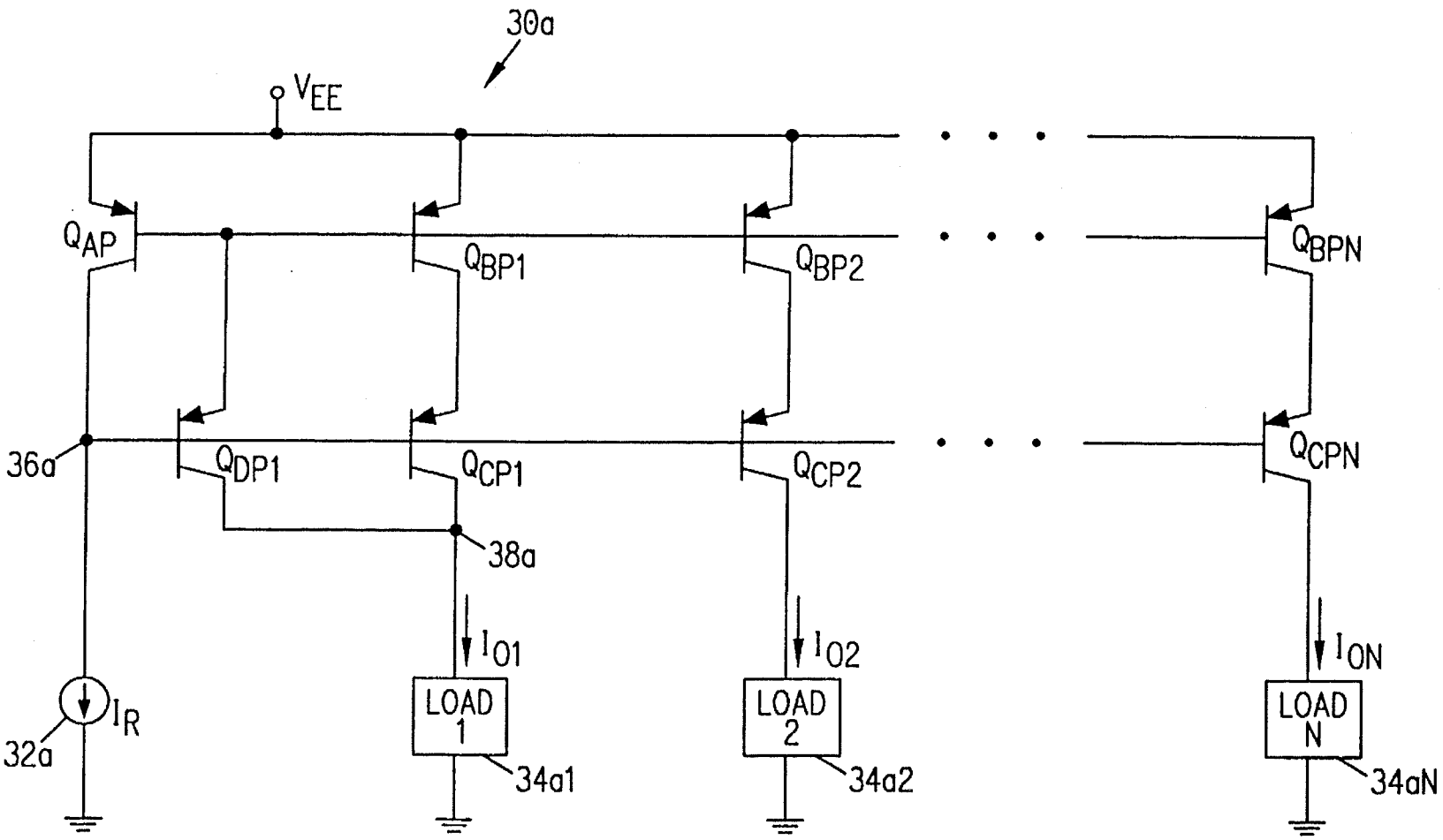
FIGS. 9A and 9B contain schematics of PNP and NPN current mirror circuits with multiple outputs using the current mirror circuits of FIGS. 7A and 7B, respectively.
Figure 9B:
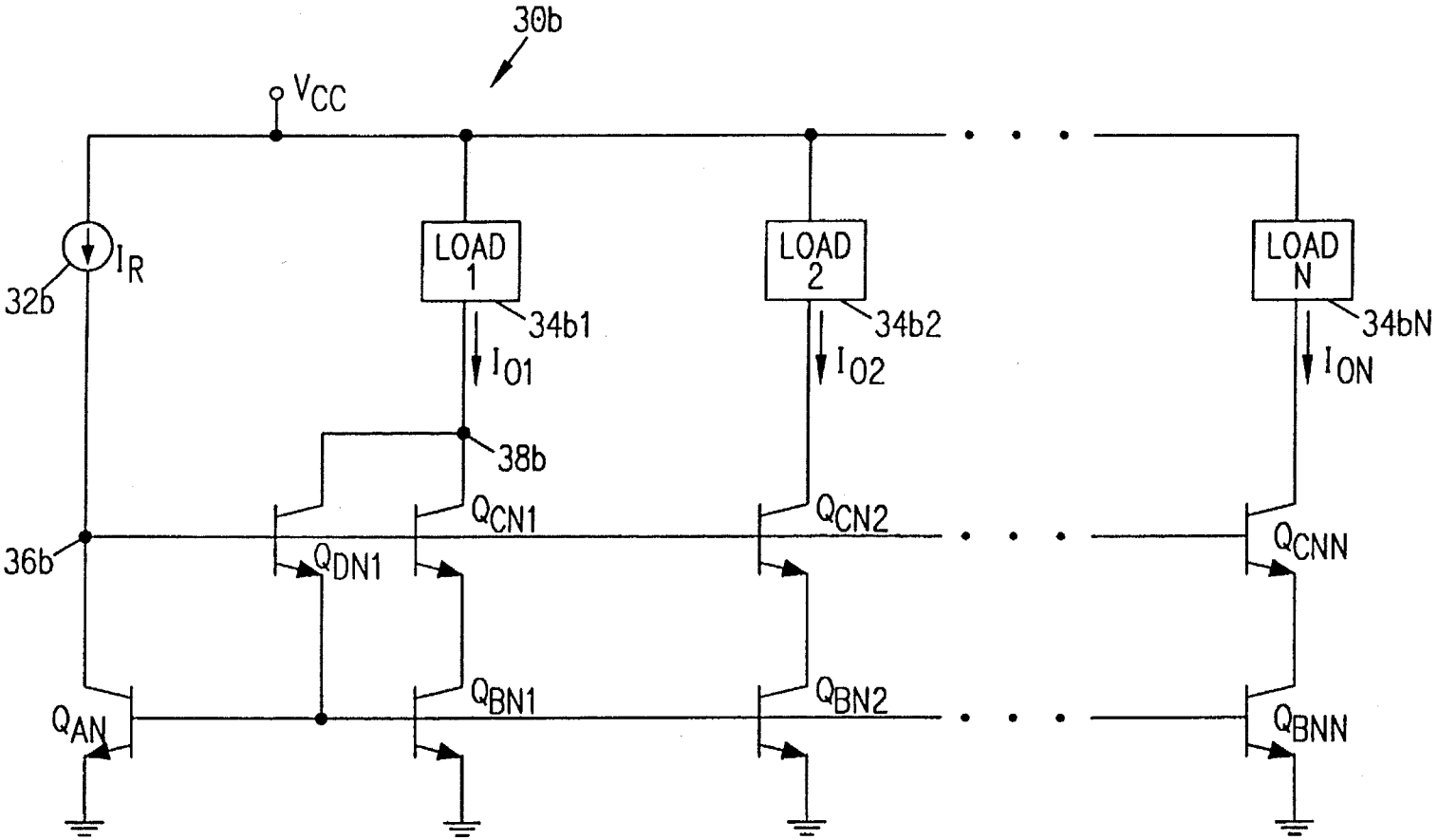

Referring to FIG. 9A, a current mirror circuit 30*a* in accordance with a further alternative preferred embodiment of the present invention can be constructed to provide multiple load currents $I_{O1}, I_{O2}, \ldots, I_{ON}$. As can be seen by comparing FIGS. 9A and 7A, the basic current mirror circuit 10*a* of FIG. 7A is used to form the core subcircuit (transistors $Q_{AP}$, $Q_{BP1}$, $Q_{CP1}$ and $Q_{DP1}$) of this multiple-output current mirror circuit 30*a*. As shown, the emitters of input transistor $Q_{AP}$ and output transistors $Q_{BP1}$–$Q_{BPN}$ are mutually coupled at a shared node, i.e. the power supply $V_{EE}$ node. The bases of these transistors $Q_{AP}$, $Q_{BP1}$–$Q_{PBN}$ are all mutually coupled, as well as coupled to the emitter of the compensation transistor $Q_{DP1}$ of the core subcircuit. The bases of the compensation transistor $Q_{DP1}$ and output transistors $Q_{CP1}$–$Q_{CPN}$ are all mutually coupled together, as well as coupled to the reference node 36*a* at the collector of input transistor $Q_{AP}$ for conduction of the reference current $I_R$.

Figure 10A:
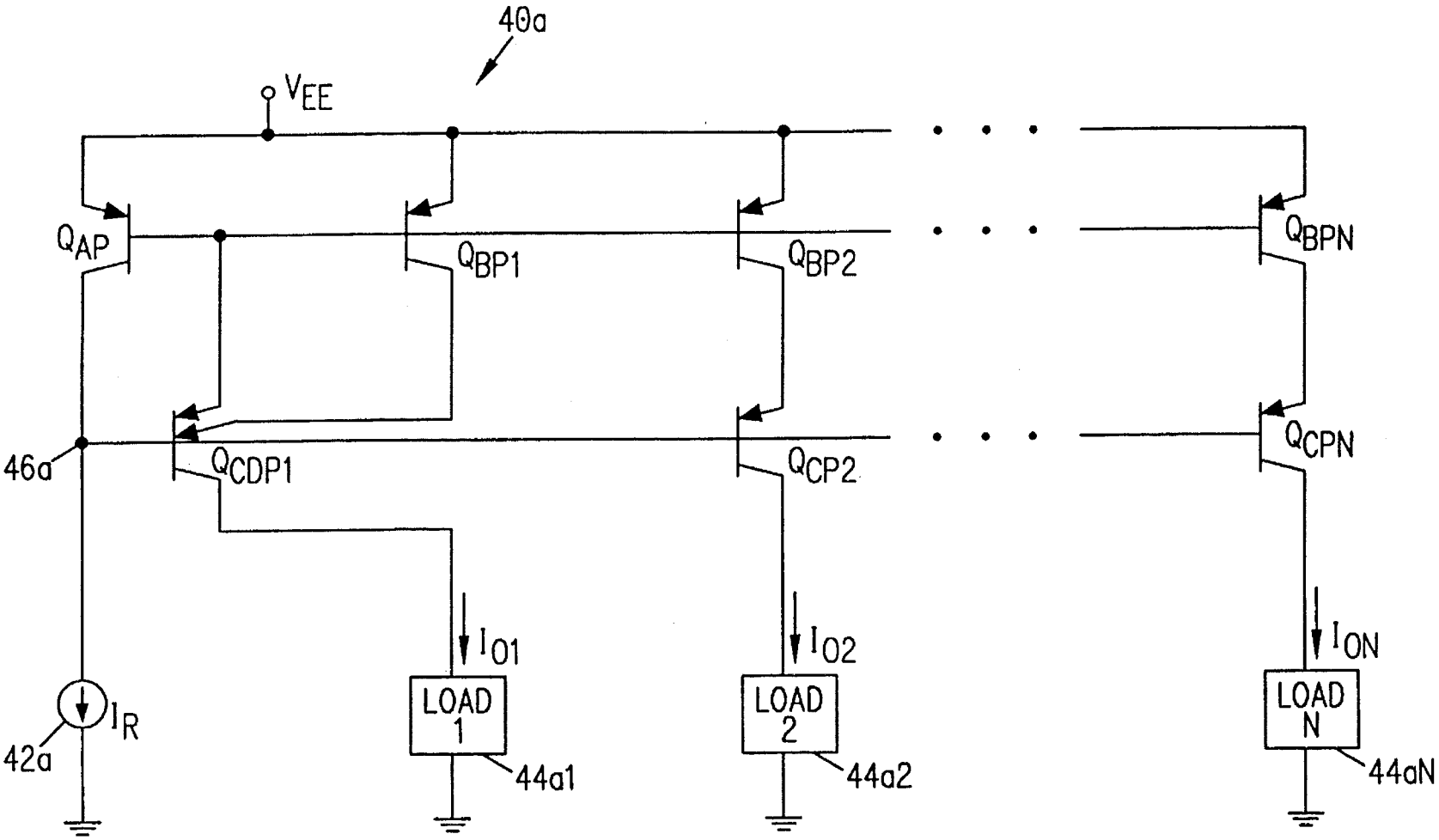
FIGS. 10A and 10B contain schematics of PNP and NPN current mirror circuits with multiple outputs using the current mirror circuits of FIGS. 8A and 8B, respectively.
Figure 10B:
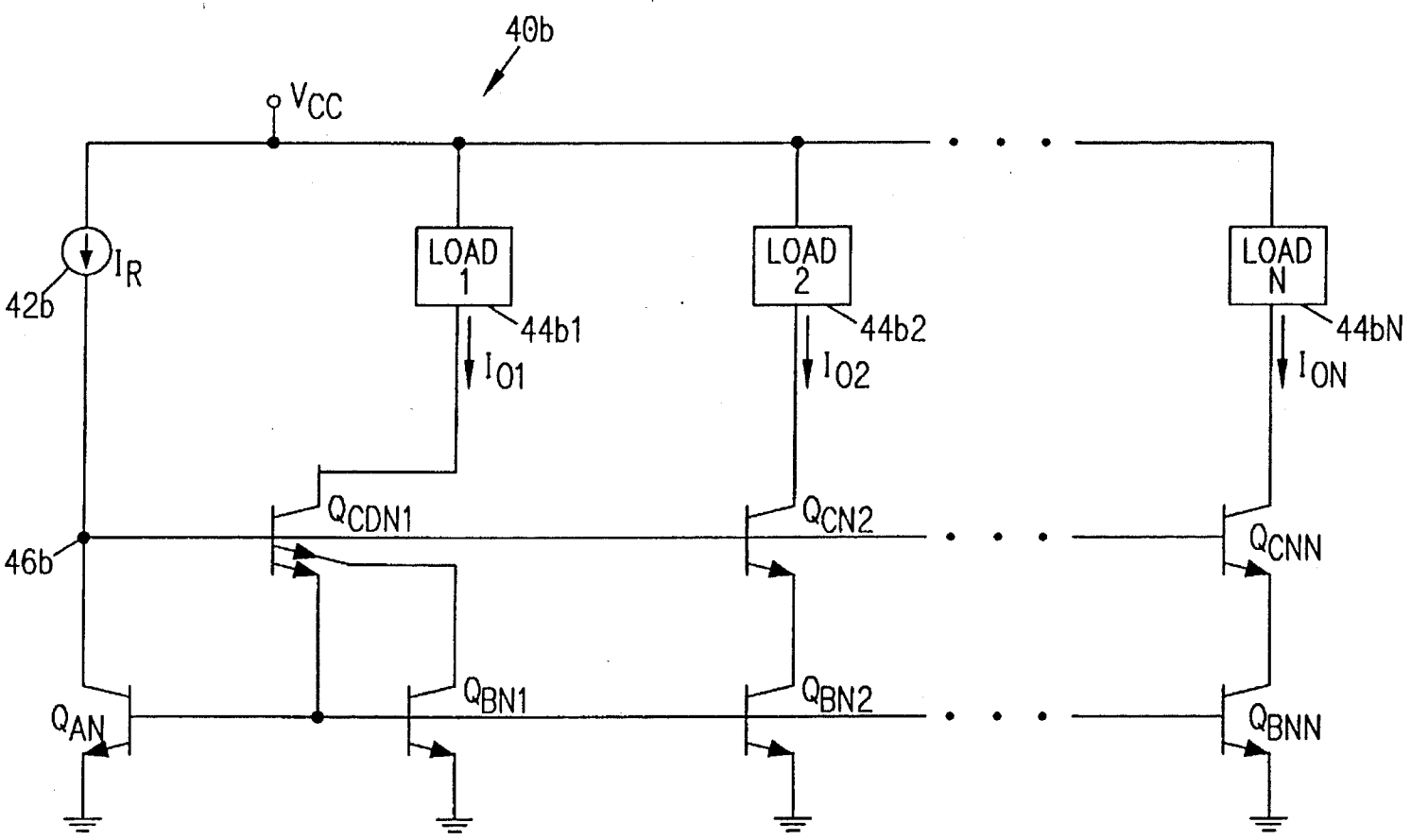

Referring to FIG. 10A, a similar multiple-output current mirror circuit 40*a* can be constructed using the basic multiple-emitter current mirror circuit 30*a* of FIG. 8A. As shown, the emitters of input transistor $Q_{AP}$ and output transistors $Q_{BP1}$–$Q_{BPN}$ are mutually coupled at a shared node, i.e. the power supply $V_{EE}$ node. The bases of these transistors $Q_{AP}$, $Q_{BP1}$–$Q_{PBN}$ are coupled together and to one emitter of the compensated output transistor $Q_{CDP1}$. The collector of output transistor $Q_{BP1}$ is coupled to the other emitter of the compensated output transistor $Q_{CDP1}$, while the collectors of output transistors $Q_{BP2}$–$Q_{BPN}$ are coupled to the emitters of their respective cascode output transistors $Q_{CP2}$–$Q_{CPN}$. The bases of the compensated output transistor $Q_{CDP1}$ and other output transistors $Q_{CP2}$–$Q_{CPN}$ are connected together and to the reference node 46*a* at the collector of the input transistor $Q_{AP}$ for conduction of the reference current $I_R$, while their respective collectors provide the output currents $I_{O1}$–$I_{ON}$ for delivery to the loads 44*a*1–44*a*N.

In the multiple-output current mirror circuits 30*a*, 30*b*, 40*a* and 40*b* of FIGS. 9A, 9B, 10A and 10B, respectively, the first output current $I_{O1}$ is selectively proportional to the reference current $I_R$, whereas the remaining output currents $I_{O2}$–$I_{ON}$ are only approximately proportional to the reference current $I_R$. In other words, due to the advantageous "beta compensation" feature of a current mirror circuit in accordance with the present invention, the first output current $I_{O1}$ can selectively be made more precisely proportional to the reference current $I_R$. However, since the remaining output circuits do not benefit from such "beta compensation", their output currents $I_{O2}$–$I_{ON}$ cannot be made as precisely proportional to the reference current $I_R$.

But, on the other hand, the multiple-output current mirror circuits 30*a*, 30*b*, 40*a* and 40*b* of FIGS. 9A, 9B, 10A and 10B, respectively, offer further advantages. For example, the number of additional output circuits ($Q_{BP2}$, $Q_{CP2}$ through $Q_{BPN}$, $Q_{CPN}$) which can be controlled by the core subcircuit ($Q_{AP}$, $Q_{BP1}$, $Q_{CP1}$, $Q_{DP1}$, [FIG. 9A]; $Q_{AP}$, $Q_{BP1}$, $Q_{CDP1}$ [FIG. 10A]) is virtually unlimited. In other words, regardless of the number of output circuits added to the core subcircuit, the reference current $I_R$ can remain fixed, i.e. the reference current $I_R$ need not be increased merely to provide sufficient drive, or control, for each additional output circuit. As should be readily understood, this allows the currents within the circuits 30*a*, 30*b*, 40*a* and 40*b* to be kept at such levels that smaller transistors can be used while still enjoying higher "betas". (However, while the additional outputs do not affect second order base current correction [$1/\beta$], higher order correction [$1/\beta^2$] is affected due to the introduction of other error terms.)

Figure 11B:
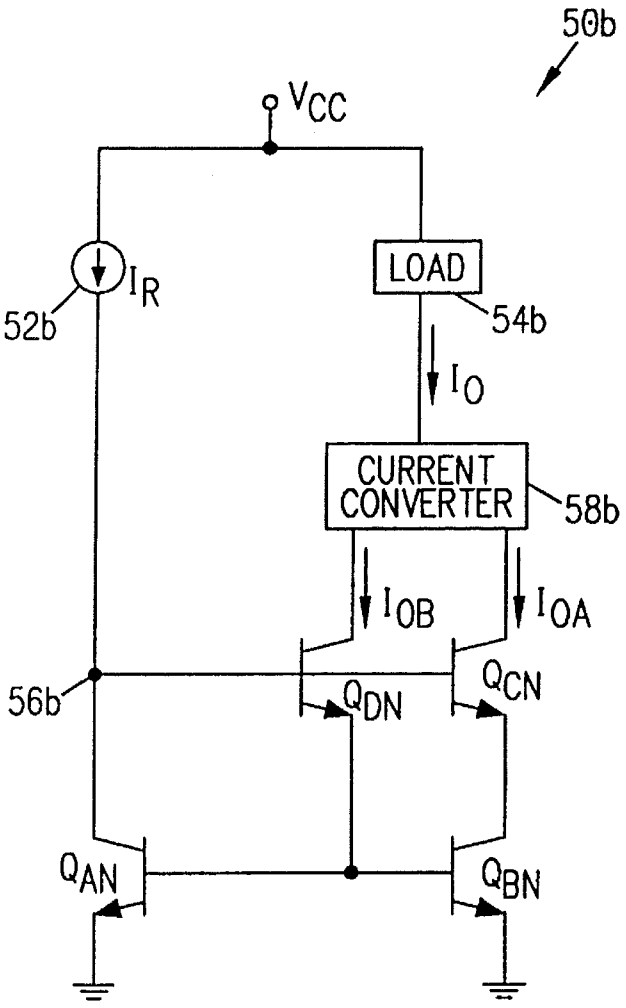
FIGS. 11A and 11B contain schematics of PNP and NPN current mirror circuits using the current mirror circuits of FIGS. 7A and 7B, respectively, with a current converter for the output current.
Figure 11A:
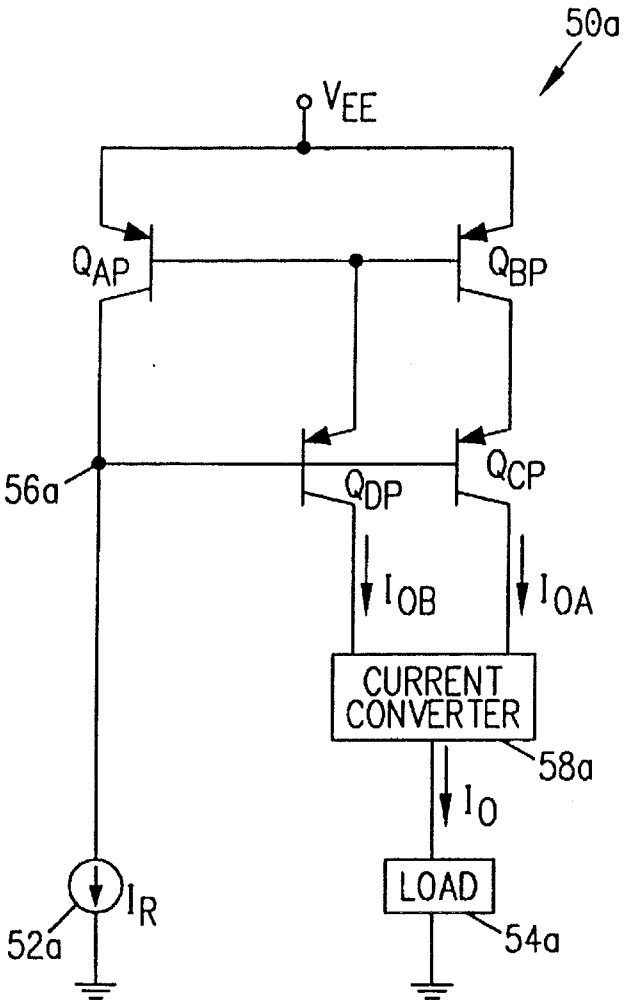

Referring to FIG. 11A, a current mirror circuit 50*a* in accordance with a still further alternative preferred embodiment of the present invention also begins with the basic current mirror circuit 10*a* of FIG. 7A, i.e. input transistor $Q_{AP}$, output transistors $Q_{BP}$ and $Q_{CP}$, and compensation transistor $Q_{DP}$. However, the collectors of the output $Q_{CP}$ and compensation $Q_{DP}$ transistors are not connected directly together. Instead, they each connect to a current converter 58*a*, which receives their respective collector currents $I_{OA}$ and $I_{OB}$, and converts them to the output current $I_O$ for delivery to the load 54*a*.

One simple version of a "current converter" 58*a* can be merely a circuit node at which the collector currents $I_{OA}$ and $I_{OB}$ are simply summed together to form the output current $I_O$. Examples of this would include output node 18*a* in FIG. 7A and output node 38*a* in FIG. 9A.

Another form of current converter 58*a* can include current buffers, e.g. with unity gain, for buffering and summing the collector currents $I_{OA}$ and $I_{OB}$ to form the output current $I_O$. Many firms of such current buffers are well known in the art.

Figure 12B:
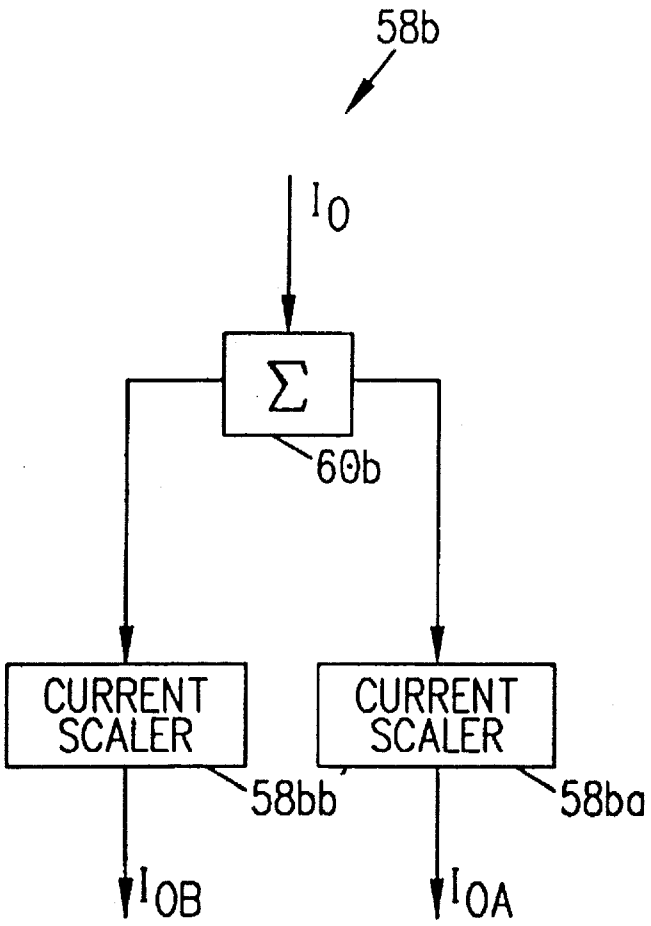
FIGS. 12A and 12B contain block diagrams of current scaling circuits suitable for use as the current converters of FIGS. 11A and 11B, respectively.
Figure 12A:
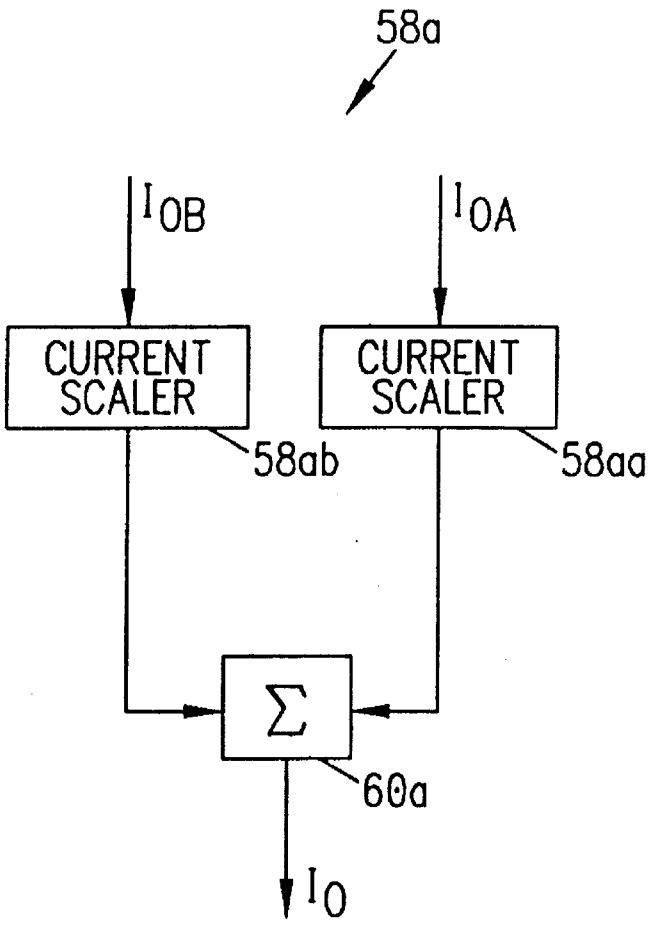

Referring to FIG. 12A, yet another form of current converter 58*a* can include current scalers 58*aa*, 58*ab* (discussed further below) and a current adder 60*a* for selectively scaling (e.g. multiplying or dividing) and summing the collector currents $I_{OA}$ and $I_{OB}$, respectively, to form the output current $I_O$. As shown, each of the collector currents $I_{OA}$ and $I_{OB}$ is inputted to its respective current scaler 58*aa* and 58*ab*. The output currents $I_A$ and $I_B$ are scaled versions (e.g. multiples or fractions) of the input currents $I_{OA}$ and $I_{OB}$, respectively, and are summed together to form the output current $I_O$.

Referring to FIG. 12B, the current converter 58*b* for an NPN circuit implementation can be a current splitter 60*b* which splits the output current $I_O$ into two current components which are selectively scaled (e.g. multiplied or divided) by current scalers 58*ba*, 58*bb* to form the collector currents $I_{OA}$, and $I_{OB}$. The collector currents $I_{OA}$ and $I_{OB}$ are each proportionally larger or smaller than the original output current $I_O$.

Referring to FIGS. 13A, 13B, 13C and 13D, exemplary circuits 58*a*1, 58*a*2, 58*b*1 and 58*b*2 for the current scalers 58*aa*, 58*ab*, 58*ba* and 58*bb* (of the current converters of FIGS. 12A and 12B) include four NPN or PNP transistors interconnected as shown. In these exemplary circuits 58*a*1, 58*a*2, 58*b*1 and 58*b*2, simple conventional current mirror circuits have been used. However, it should be understood that other types of current multipliers or dividers can be used as well.

Figure 13C:
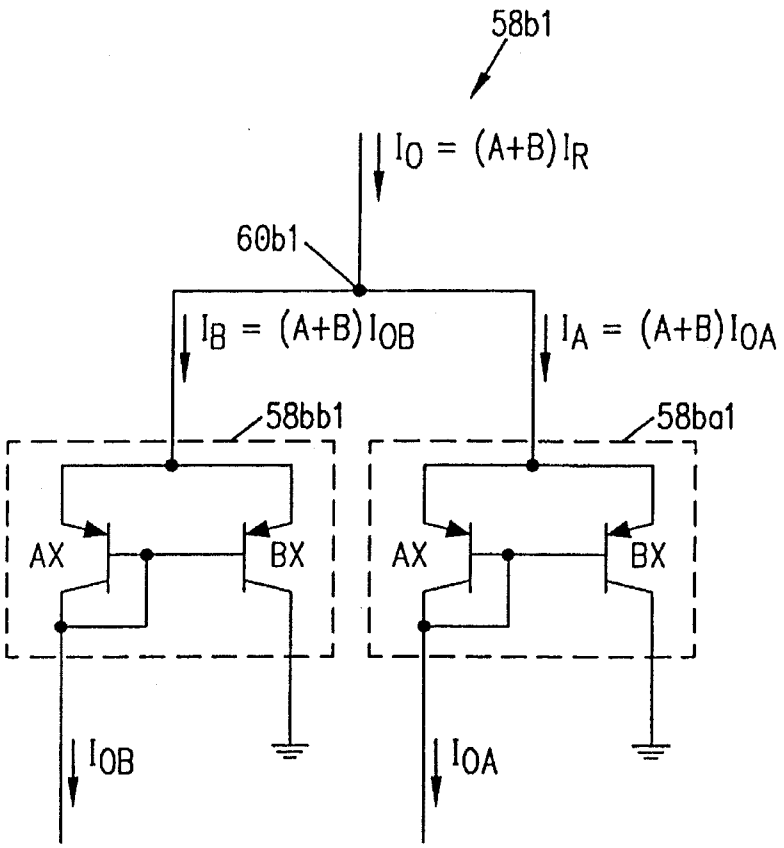
FIGS. 13C and 13D contain schematics of exemplary current multiplier and divider circuits, respectively, suitable for use as the current scalers of FIG. 12B.
Figure 13A:
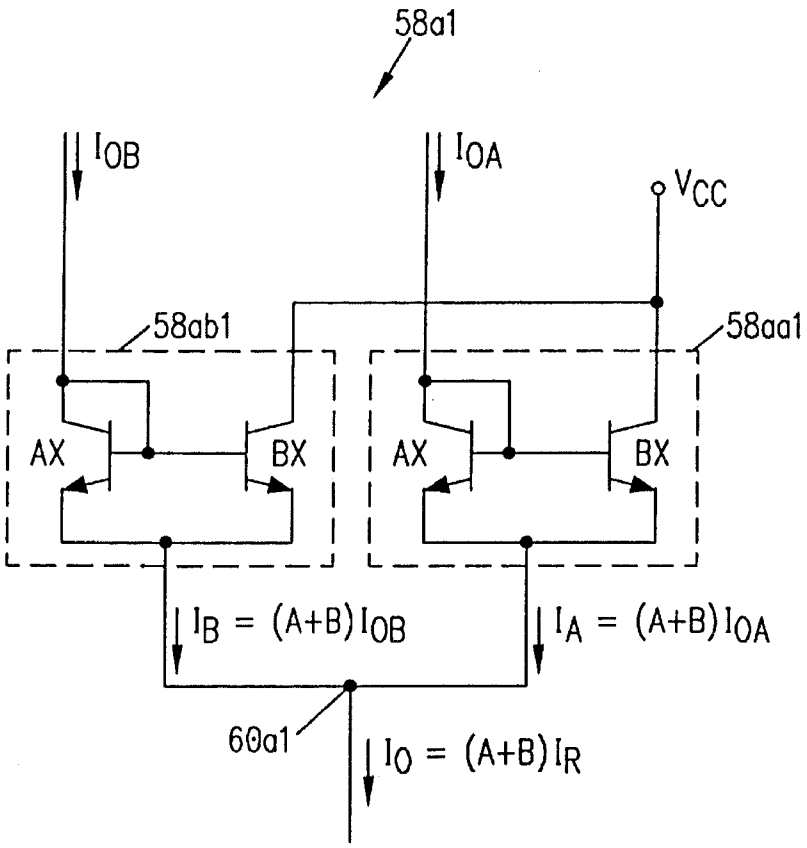
FIGS. 13A and 13B contain schematics of exemplary current multiplier and divider circuits, respectively, suitable for use as the current scalers of FIG. 12A.
Figure 13B:
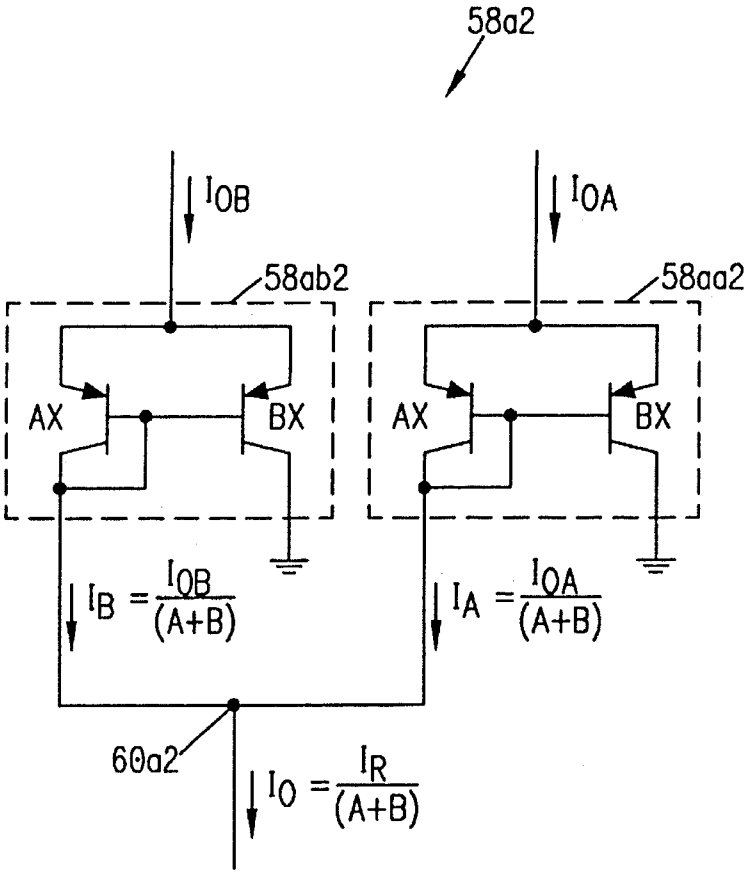
Figure 13D:
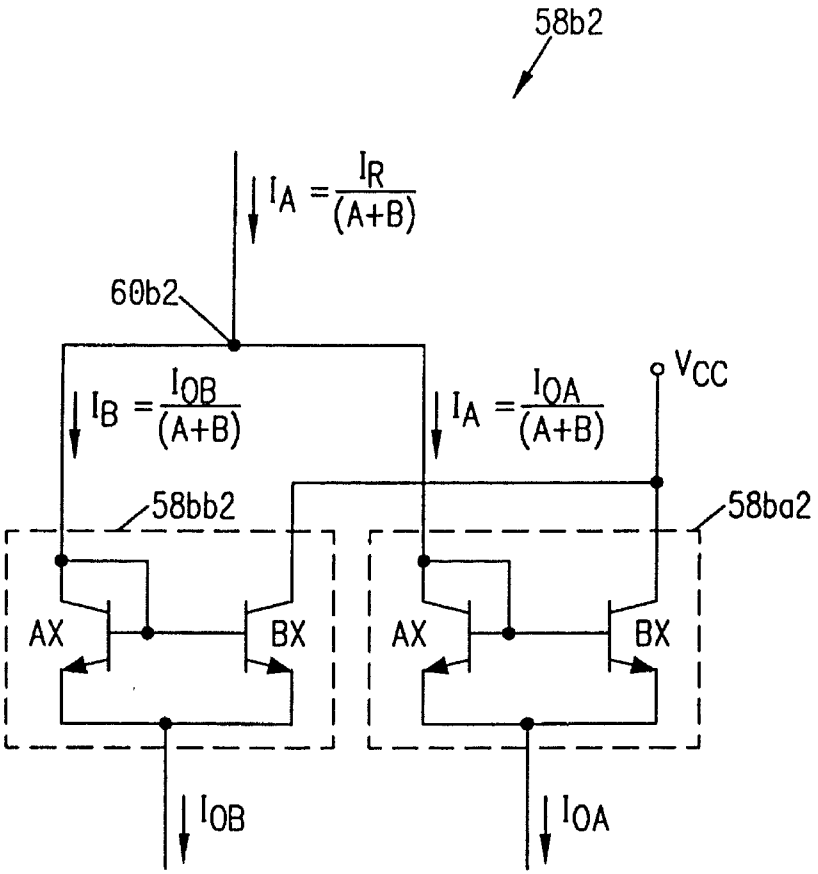

As shown in FIG. 13A, each of the collector currents $I_{OA}$ and $I_{OB}$ is inputted to its respective current scaler 58*aa*1 and 58*ab*1. The output currents $I_A$ and $I_B$ are multiples or fractions of the input currents $I_{OA}$ and $I_{OB}$, respectively, in accordance with the scaling factors "A" and "B" of the transistors. For example, if the scaling factors A and B are each unity, the scaled collector currents $I_A$ and $I_B$ are each twice as large as their respective input currents $I_{OA}$ and $I_{OB}$, thereby making the output current $I_O$ two times the value of the reference current $I_R$. (Based upon the foregoing, the similarities of operation of the circuits of FIGS. 13B, 13C and 13D should be understood.)

Figure 14A:
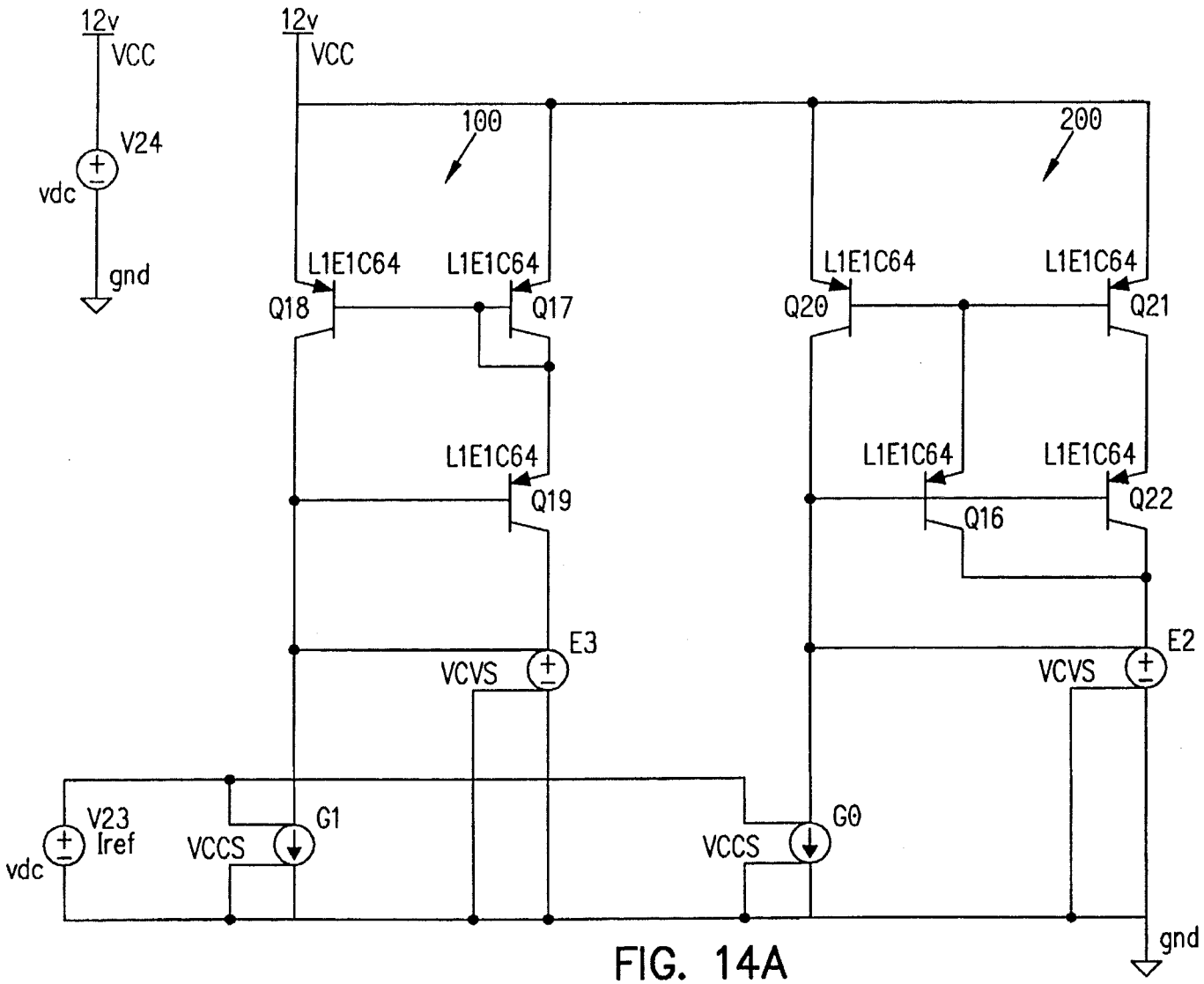
FIGS. 14A and 14B contain schematics of and a graphical comparison between, respectively, simulated performances of a conventional "Wilson" current mirror circuit model and a current mirror circuit model in accordance with a preferred embodiment of the present invention.

Referring to FIG. 14A, models of a conventional "Wilson" current mirror circuit 100 and a current mirror circuit 200 in accordance with a preferred embodiment of the present invention (per FIG. 7A) were constructed. The amplitudes of the input, or reference, currents for these circuits 100, 200 were swept over a range of 1 microampere to 1 milliampere. The output currents for each circuit 100, 200 were noted and compared against the input currents. The resulting current transfer characteristics, in the form of percentage errors, were then computed and are shown in graphical form in FIG. 14B. As can be seen, at very low currents, e.g. 20 micro-amperes and below, the circuits 100, 200 perform similarly with respect to their output versus input current tracking performance. However, as the input current increases, their current transfer characteristics begin to diverge significantly. For example, as the input current increases to 1 milliampere, the percentage error for the "Wilson" current mirror circuit 100 increases to beyond 20% (negative), whereas the percentage error for the current mirror circuit 200 in accordance with a preferred embodiment of the present invention (per FIG. 7A) peaks at less than 3% (positive).

The beta versus collector current ($\beta$ vs. $I_C$) curve typically resulting from most bipolar silicon processes is a well behaved, monotonically decreasing function beyond the peak value of beta. A current mirror circuit in accordance with the present invention makes use of this characteristic to reduce the input-to-output current error over a wide operating range. With reference to FIGS. 14A and 14B, this can be explained intuitively and qualitatively as follows.

For the moment, the base current of Q16 is neglected and the betas of Q20, Q21 and Q22 are high enough that the base currents of Q21 and Q22 can be approximated as being equal (i.e. $I_{B21}=I_{B22}$). Further, it is momentarily assumed that the collector of Q16 is not connected to the collector of Q22, but rather, is connected to a voltage source which causes Q16 to be functioning in its forward active operating region. Given these conditions, it can be seen that an error is introduced by Q22, i.e. the base current of Q22 ($I_{B22}$) is subtracted from the output current $I_O$ and added to the reference current $I_R$ (the sum of the collector current $I_{C20}$ Of Q20 and the base current $I_{B22}$ of Q22). Thus, the output current $I_O$ is smaller than the reference current $I_R$ by "$2I_B$".

Now, by "reconnecting" the collector of Q16 to the collector of Q22, it can be seen that the current flowing through Q16 is the sum of the base currents $I_{B20}$ and $I_{B21}$ of Q20 and Q21, respectively. This results in making the output current $I_O$ larger by "$2I_B$", and therefore, equal to the reference current $I_R$. Simply put, the base currents $I_{B20}$ and $I_{B21}$ of Q20 and Q21, respectively, flow through Q16 to compensate for the base current $I_{B22}$ of Q22.

However, for low betas, the assumption that $I_{B21}=I_{B22}$ is not valid. For example, if the betas of Q21 and Q22 are each ten ($\beta_{21}=\beta_{22}=10$), then the ratios of the collector and base currents of Q21 to those of Q22 are non-unity ($I_{C21}/I_{C22}=I_{B21}/I_{B22}=1.1$). Indeed, for actual silicon devices, the current mismatches are worse than this. The device with lower collector current (Q22) has a higher beta, i.e. $\beta_{22}>\beta_{21}$; therefore $I_{B21}/I_{B22}>I_{C21}/I_{C22}$. As the reference current $I_R$ is increased and the betas decrease, this base current mismatch causes an increasingly positive error ($I_O>I_R$). It is this phenomenon which is responsible for the rising portion of the error versus output current curve (FIG. 14B).

Consider now the effect of a finite beta $\beta_{16}$ for Q16 which has the same emitter area as Q1 but lower current density. While the beta $\beta_{16}$ for Q16 is larger than the beta $\beta_{20}$ for Q20 for most of its operating range, $\beta_{16}$ decreases more rapidly than $\beta_{20}$ as the reference current $I_R$ increases because the emitter current $I_{E16}$ of Q16 increases as $2I_{C20}/\beta_{20}$. As $\beta_{16}$ decreases, the positive error caused by the base currents mismatch of Q21 and Q22 reduces and eventually reverses, passing through zero at $\beta_{16}=2\beta_{20}+1$.

Figure 14B:
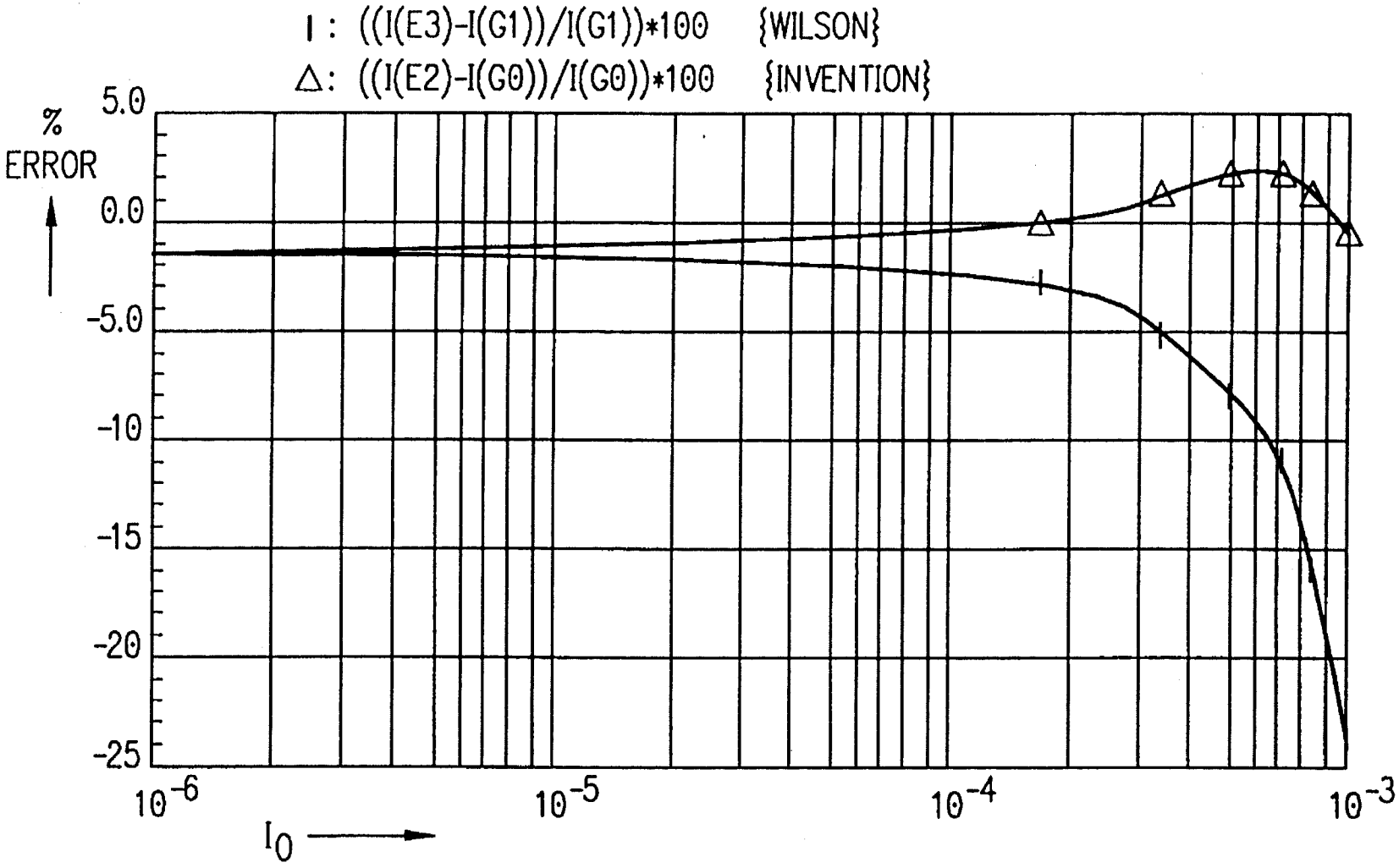
Figure 15A:
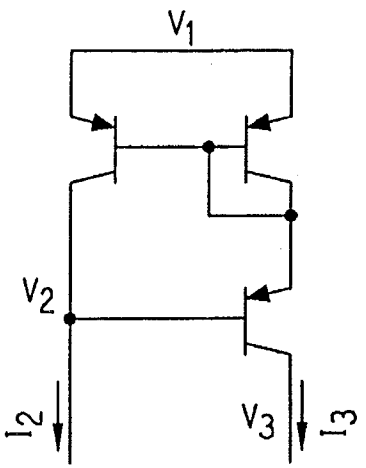
FIG. 15A contains a schematic and graph of an actual output-versus-input current performance for a conventional "Wilson" current mirror circuit.
Figure 15A:
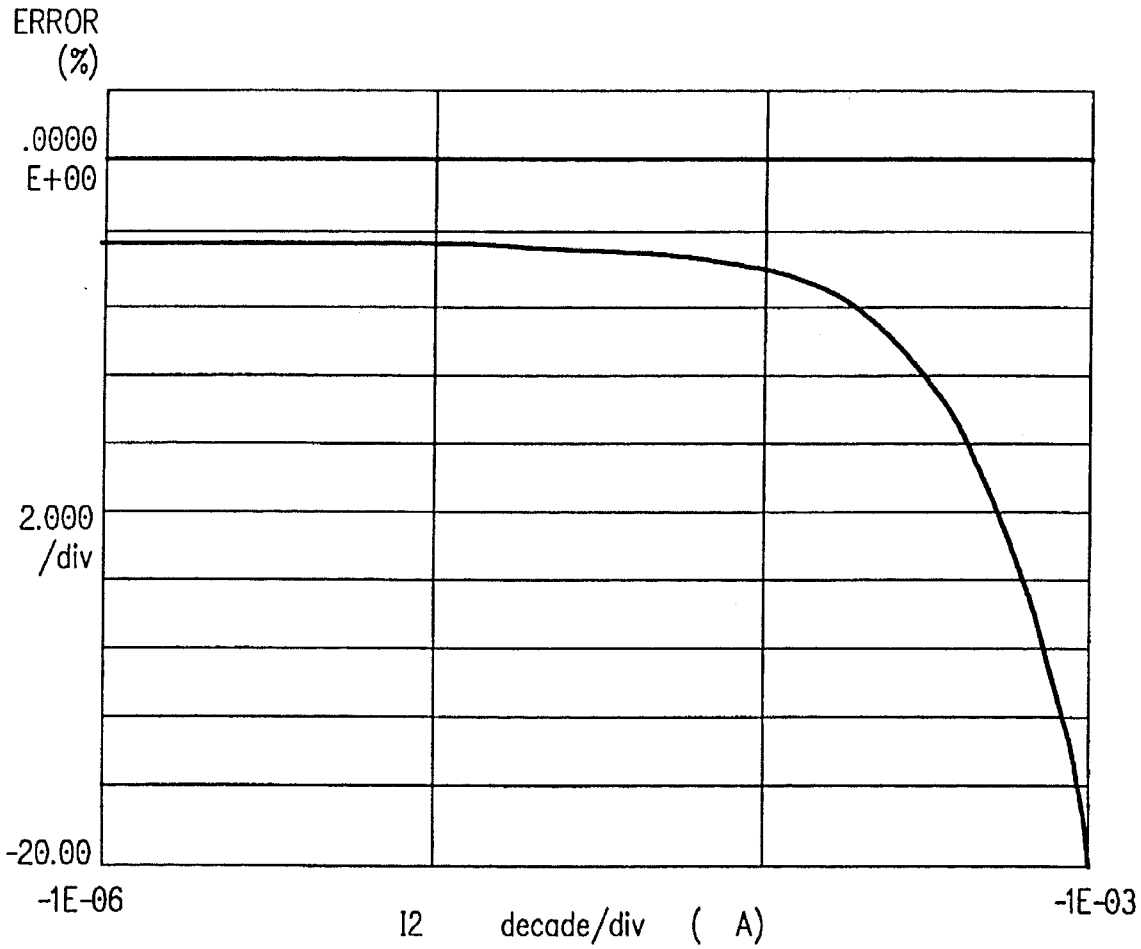
Figure 15B:
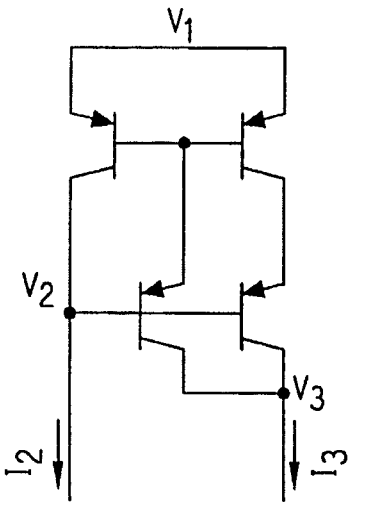
FIG. 15B contains a schematic and graph of an actual output-versus-input current performance for a current mirror circuit in accordance with a preferred embodiment of the present invention.
Figure 15B:
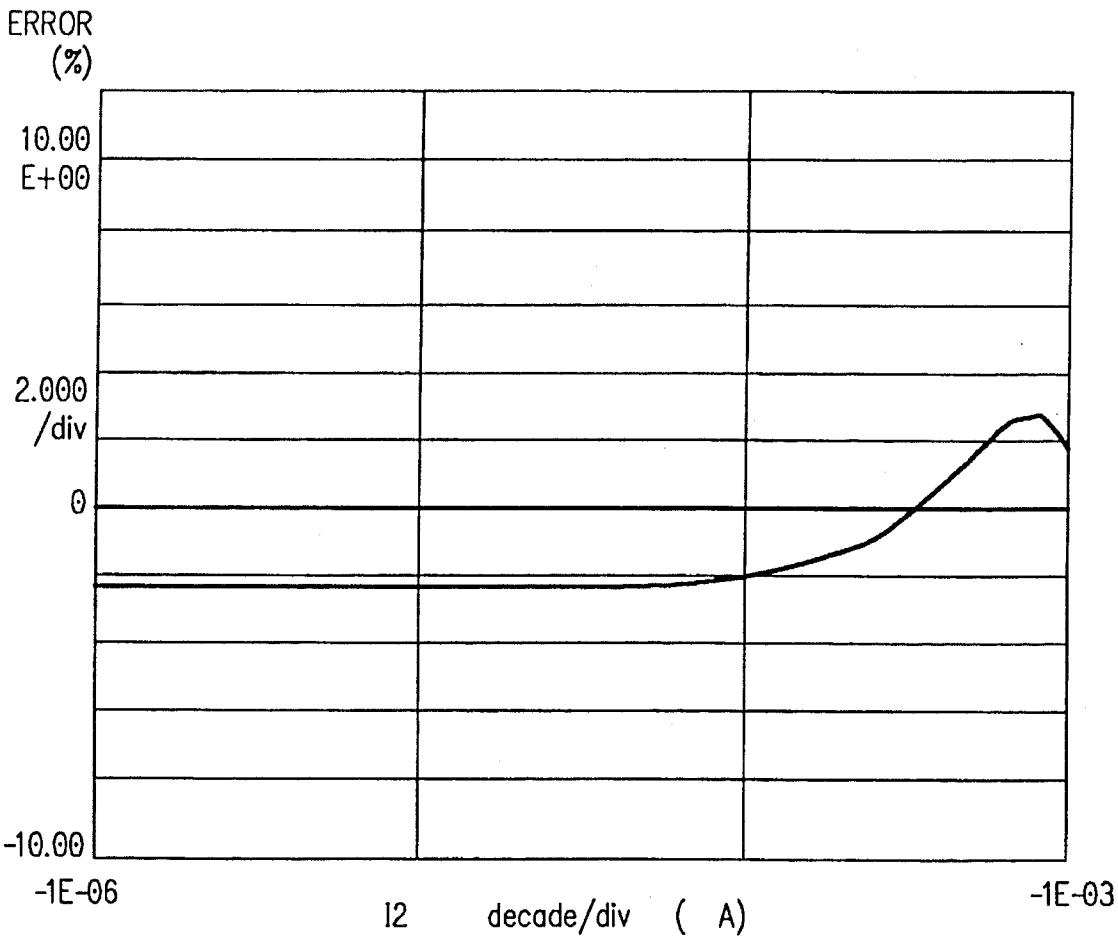

Referring to FIGS. 15A and 15B, actual circuits were constructed based upon the circuit models of FIG. 14A, and were tested for comparison with the simulation results of FIG. 14B. As can be seen, the actual results track the simulation results quite closely for both the "Wilson" current mirror circuit (FIG. 15A) and a current mirror circuit in accordance with a preferred embodiment of the present invention (FIG. 15B).

Figure 16B:
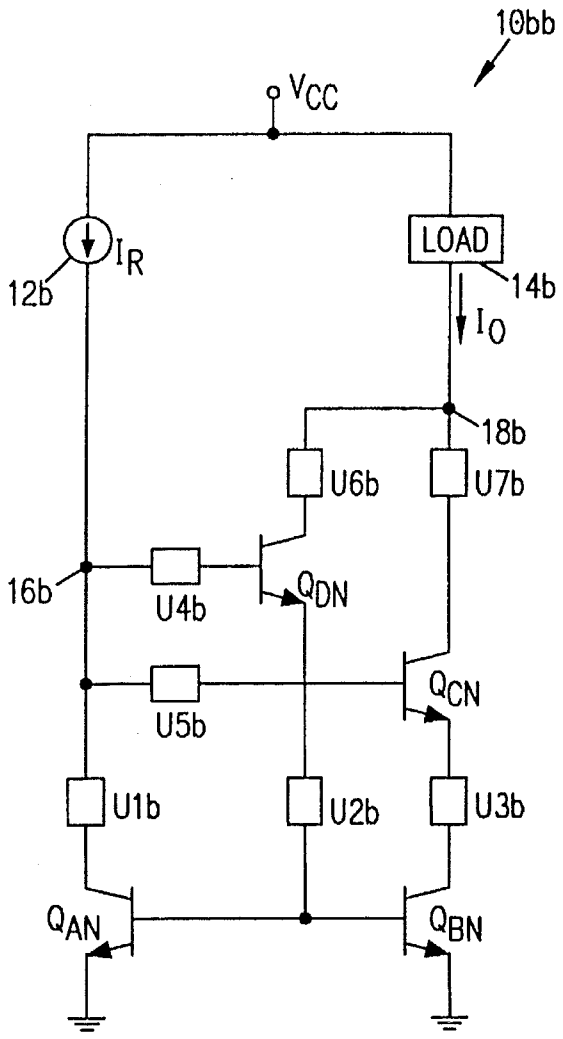
FIGS. 16A–B illustrate conceptually, in schematic form, how a current mirror circuit in accordance with a preferred embodiment of the present invention can be realized by interconnecting the individual transistors through various types of coupling elements.
Figure 16A:
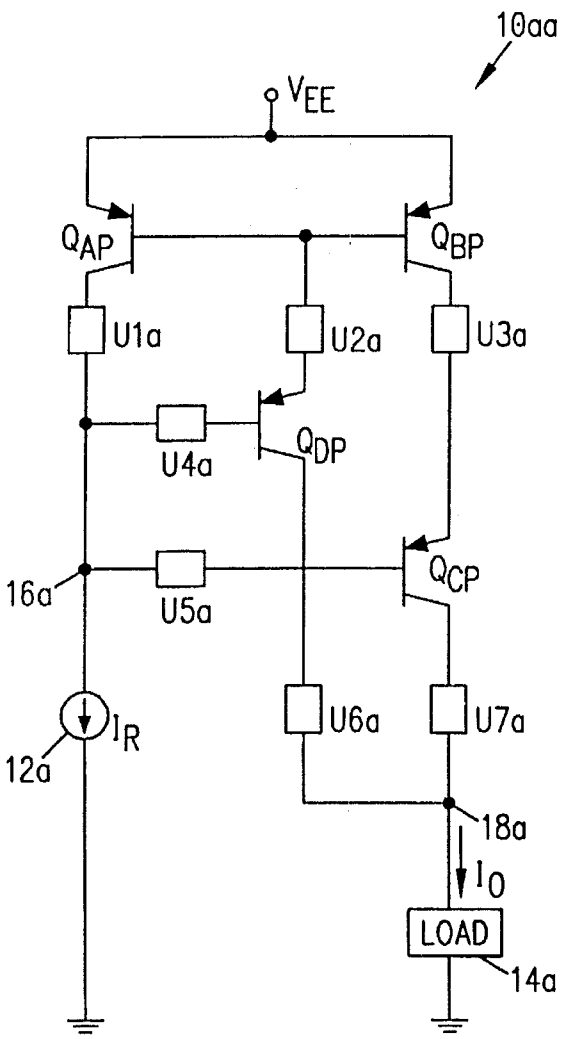

Referring to FIG. 16A, and in accordance with the foregoing discussion, it should be understood that a current mirror circuit 10*aa* in accordance with a preferred embodiment of the present invention can be realized by interconnecting the individual transistors $Q_{AP}$, $Q_{BP}$, $Q_{CP}$, and $Q_{DP}$ through various types of coupling elements U1*a*, U2*a*, U3*a*, U4*a*, U5*a*, U6*a* and U7*a*. In other words, the interconnecting of each of the individual transistors $Q_{AP}$, $Q_{BP}$, $Q_{CP}$, and $Q_{DP}$ need not necessarily be done such that each coupling element U1*a*, U2*a*, U3*a*, U4*a*, U5*a*, U6*a*, U7*a* constitutes a zero-impedance dc connection. Rather, as long as they conduct current, these coupling elements U1*a*, U2*a*, U3*a*, U4*a*, U5*a*, U6*a*, U7*a* can be more complex, e.g. from low impedance components such as resistors or inductors to more complex combinations such as circuits. (For example, more complex coupling elements for U6*a* and U7*a* can include circuits such as the current converters 58*a* and 58*b* of FIGS. 11A and 11B, respectively, discussed above.

Based upon the foregoing discussion, it can be seen that the circuit topology of a current mirror circuit in accordance with the present invention provides a current-compensated current source while maintaining a high output impedance (due to the cascode output devices $Q_B$, $Q_C$ [FIG. 7]). A compensation transistor coupled between the input and output provides compensation for variances in the transistor current gains which occur at larger magnitudes of input current. One advantage of the present invention, particularly with respect to current mirror circuits using PNP transistors, is that smaller devices can be used. In other words, it no longer becomes necessary to increase the sizes of the transistors simply to overcome problems which would otherwise be introduced by decreasing values of transistor current gains caused by increasing amounts of input current.

Figure 17:
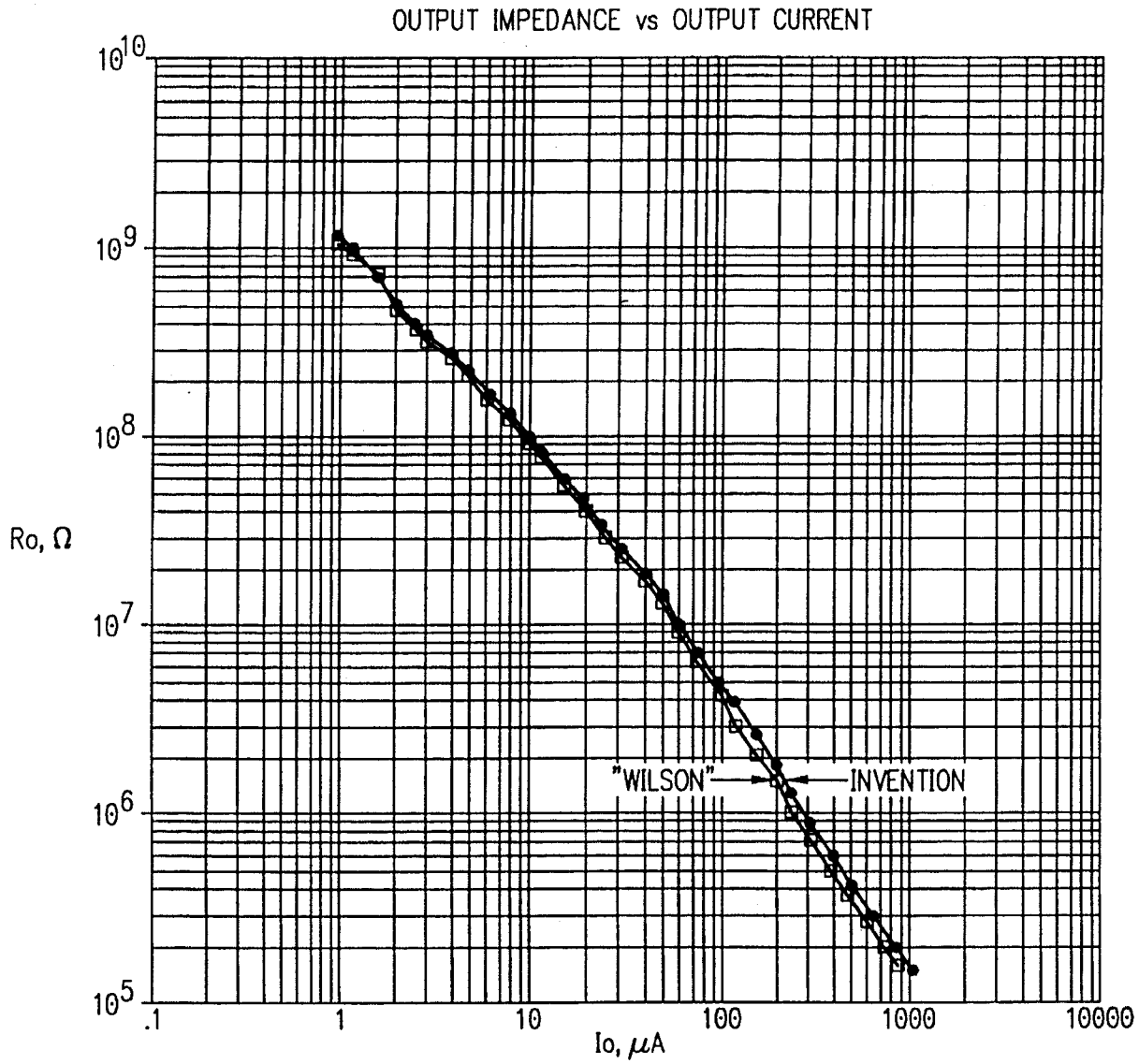
FIG. 17 is a graph of output impedance versus output current for a conventional "Wilson" current mirror circuit and for a current mirror circuit in accordance with a preferred embodiment of the present invention.

For example, referring to FIG. 17, it can be seen that over an output current ($I_O$) range of one micro-ampere through one milliampere (1 μA–1 mA), the output impedance ($R_O$) of a current mirror circuit in accordance with the present invention tracks very closely that of a conventional "Wilson" current mirror circuit over the range of approximately one thousand megohms through one hundred forty kilohms (1000–0.14 MΩ). Indeed, at higher levels of output current, e.g. at $I_O$=100–1000 μA, the output impedance of a current mirror circuit in accordance with the present invention remains higher than that of a conventional "Wilson" current mirror circuit.

Figure 18:
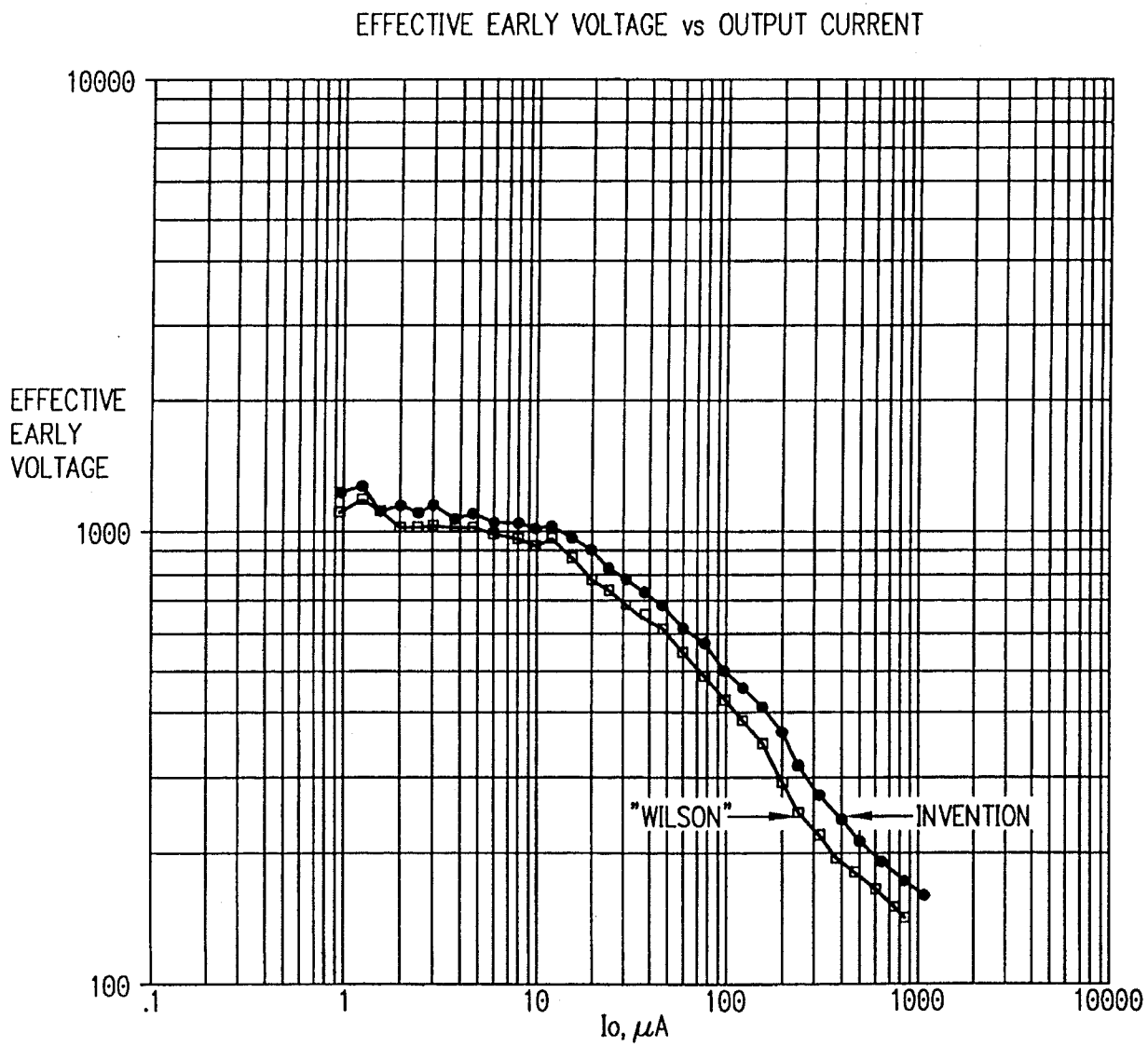
FIG. 18 is a graph of effective early voltage versus output current for a conventional "Wilson" current mirror circuit and for a current mirror circuit in accordance with a preferred embodiment of the present invention.

Referring to FIG. 18, consistent with the foregoing is another feature of a current mirror circuit in accordance with the present invention, namely that of an increased effective "Early voltage" ($V_{A(Eff)}$). As is known, the Early voltage $V_A$ for an individual transistor, generally considered to be a constant, is defined as $V_A=r_OI_C$. The effective Early voltage for a current mirror circuit, which varies with beta over the output current range, is defined as $V_{A(Eff)}=R_OI_O\approx(\beta/2)r_OI_C$; therefore $V_{A(Eff)}\approx(\beta/2)V_A$.

Figure 1B:
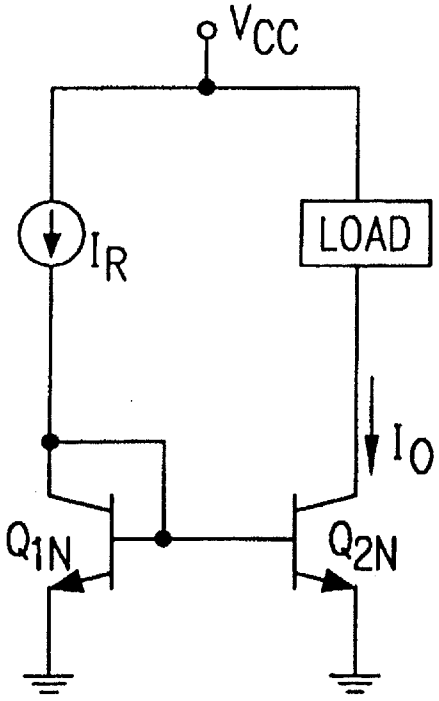
FIG. 1B PRIOR ART
FIGS. 1A and 1B contain schematics of conventional PNP and NPN current mirror circuits, respectively.
Figure 1A:
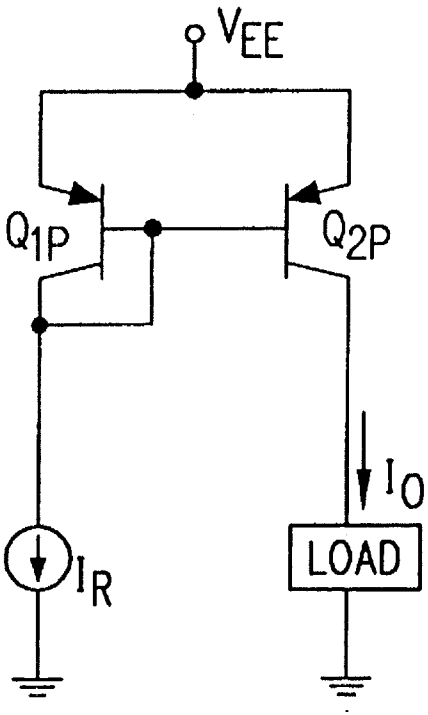
FIG. 1A PRIOR ART
Figure 2B:
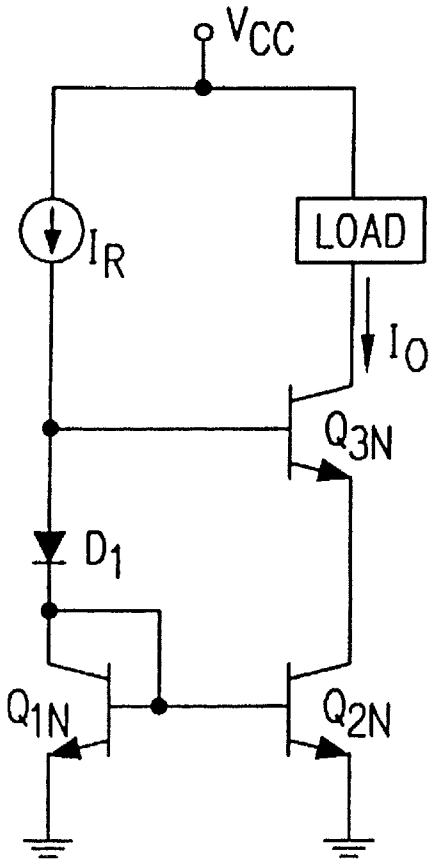
FIG. 2B PRIOR ART
FIGS. 2A and 2B contain schematics of conventional PNP and NPN cascode output current mirror circuits, respectively.
Figure 2A:
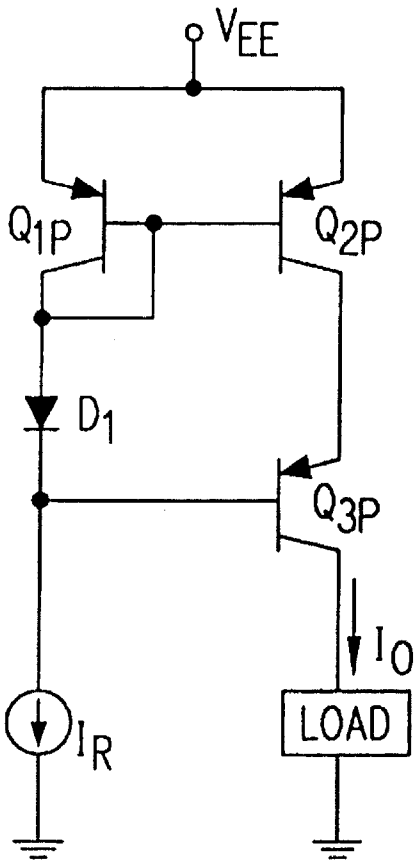
FIG. 2A PRIOR ART
Figure 3B:
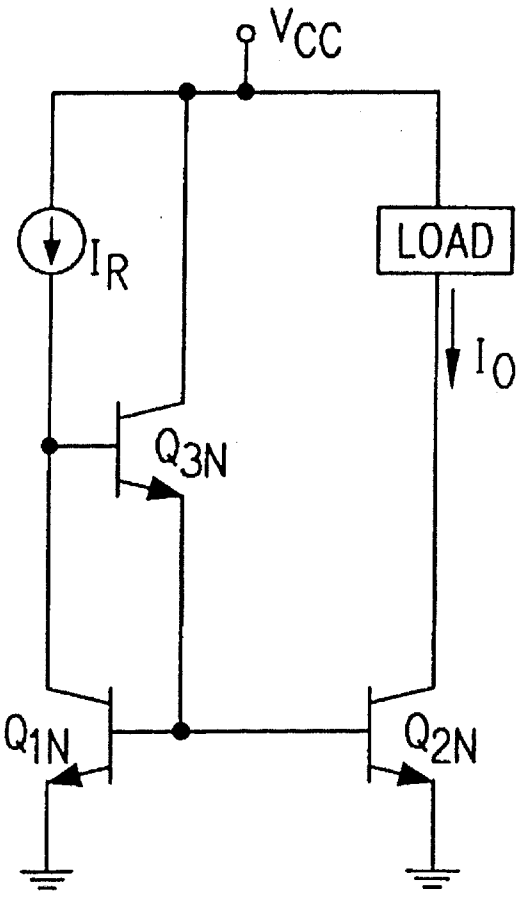
FIG. 3B PRIOR ART
FIGS. 3A and 3B contain schematics of conventional PNP and NPN "super diode" current mirror circuits, respectively.
Figure 3A:
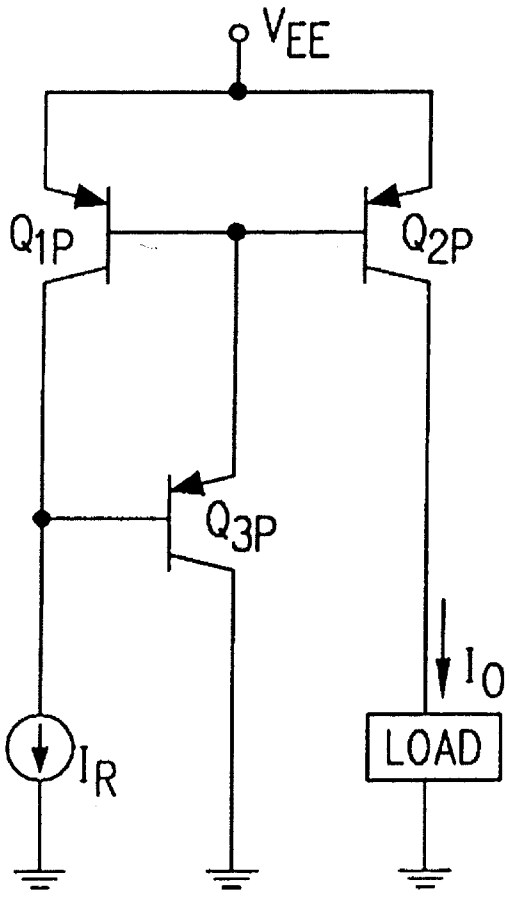
FIG. 3A PRIOR ART
Figure 4B:
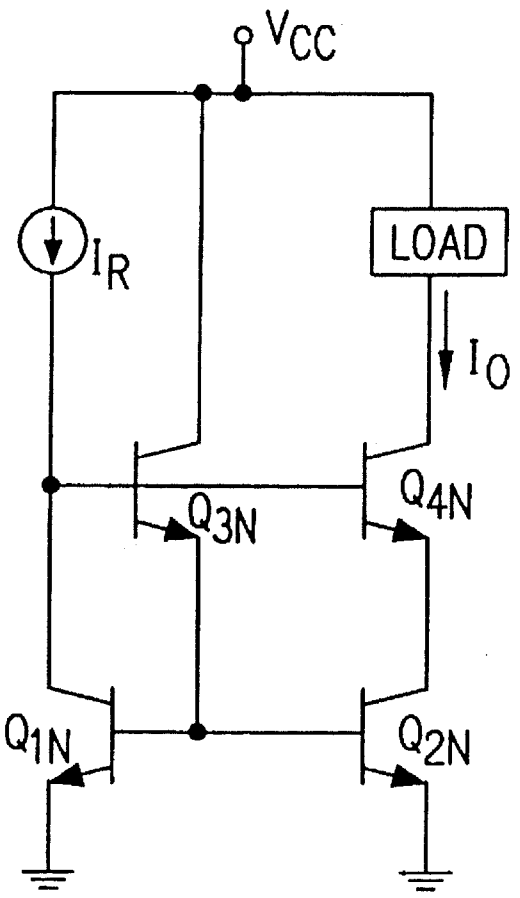
FIG. 4B PRIOR ART
FIGS. 4A and 4B contain schematics of conventional PNP and NPN cascode output, "super diode" current mirror circuits, respectively.
Figure 4A:
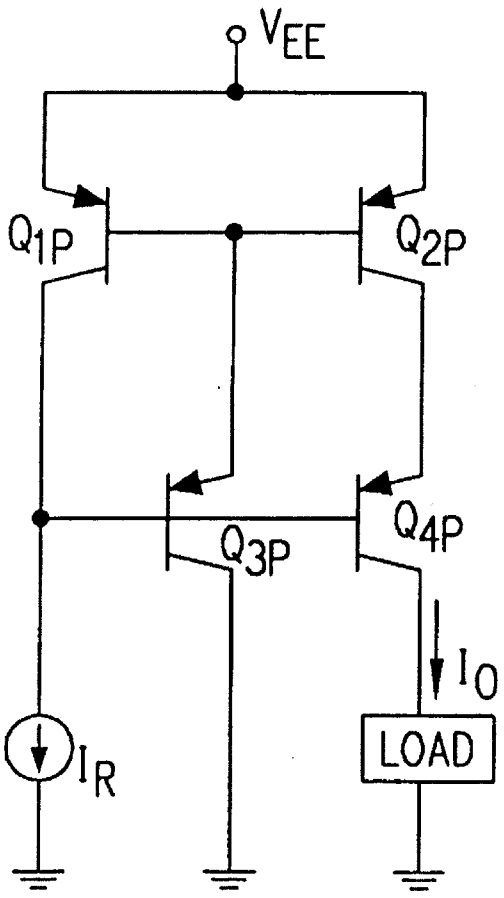
FIG. 4A PRIOR ART
Figure 5B:
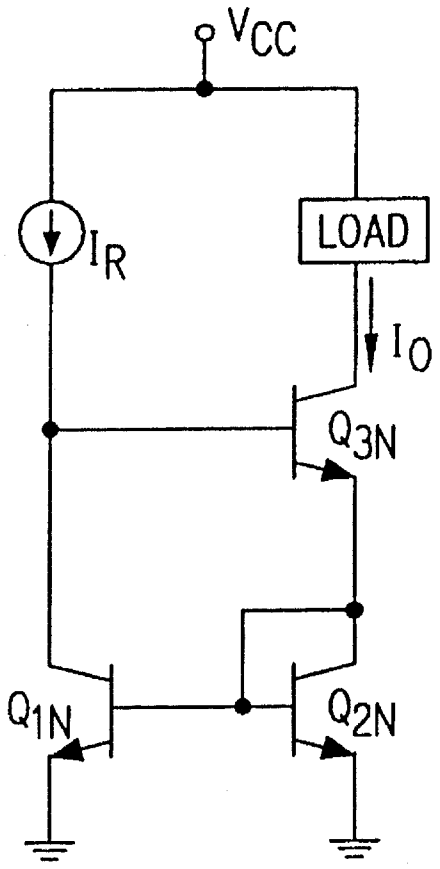
FIG. 5B PRIOR ART
FIGS. 5A and 5B contain schematics of conventional PNP and NPN "Wilson" current mirror circuits, respectively.
Figure 5A:
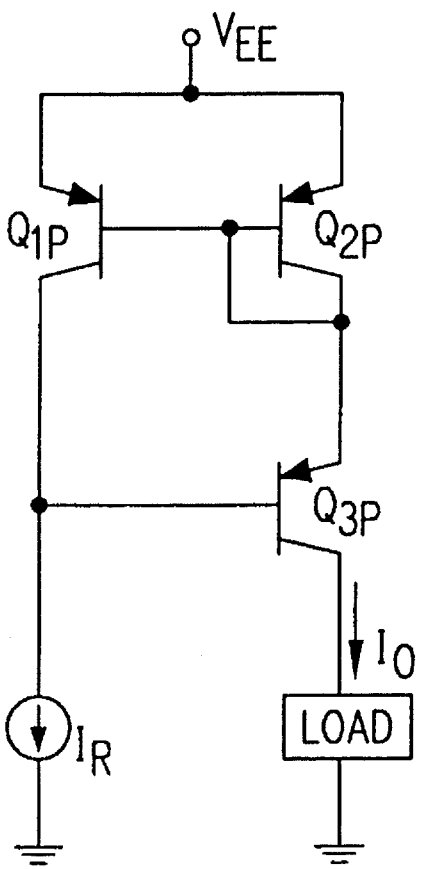
FIG. 5A PRIOR ART
Figure 6B:
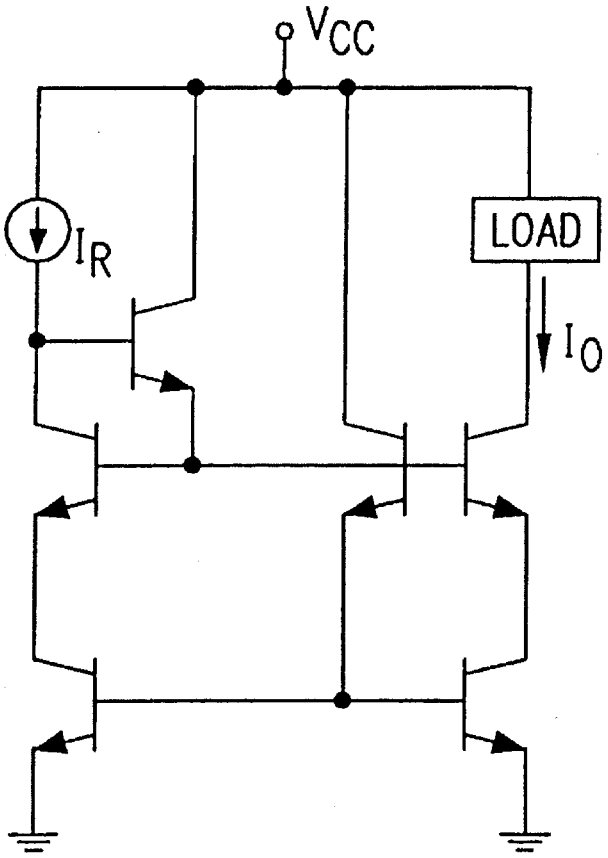
FIG. 6B PRIOR ART
FIGS. 6A and 6B contain schematics of conventional PNP and NPN modified "Wilson" current mirror circuits, respectively.
Figure 6A:
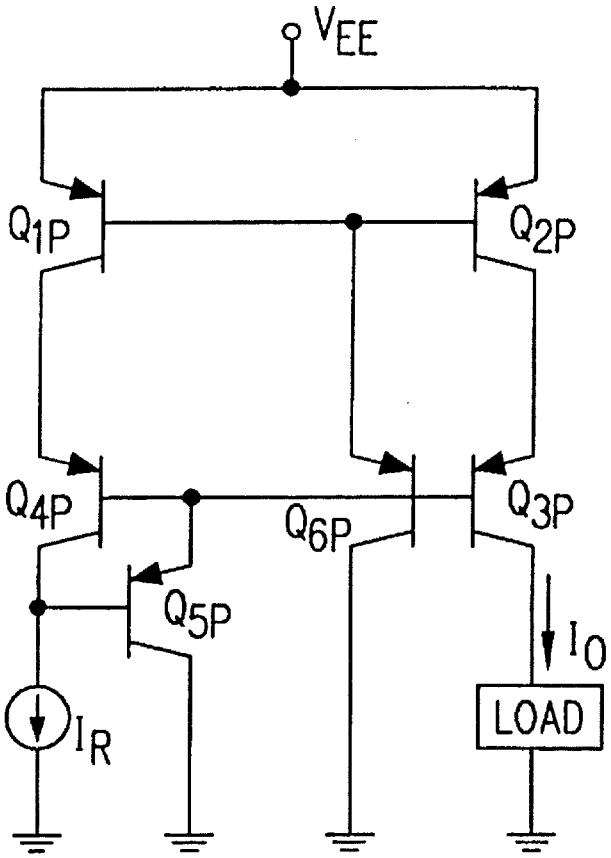
FIG. 6A PRIOR ART

Further, when a current mirror circuit in accordance with the present invention is implemented in monolithic semiconductor form using an N-epitaxial bipolar process, several advantageous layout techniques are possible. For example, as seen in FIG. 8B, an NPN version can be realized with three NPN transistors (with one being a multiple, e.g. dual, emitter device). The die area required for this design is little, if any, larger than that required for a conventional three-transistor "Wilson" current source (FIG. 5B). And, the PNP version (FIG. 8A) requires only two isolation tubs, one for each base node. Moreover, the collectors of transistors $Q_{CP}$ and $Q_{DP}$ (FIG. 7A) need not necessarily be connected with metal if their collectors are made of a single diffusion of P-type material. Transistors $Q_{CP}$ and $Q_{DP}$ can be fabricated as a single lateral PNP device $Q_{PCD}$ with a single base (epitaxial N-well) region, a single collector and two separate emitter diffusions (see FIG. 8A).

Various other modifications and alterations in the structure and method of operation of this invention will be apparent to those skilled in the art without departing from the scope and spirit of this invention. Although the invention has been described in connection with specific preferred embodiments, it should be understood that the invention as claimed should not be unduly limited to such specific embodiments.

What is claimed is:

1. A current mirror circuit for conducting a reference current and in accordance therewith conducting a plurality of output currents whose sum is proportional thereto, comprising:

a first transistor which includes a first emitter, a first base and a first collector, wherein said first emitter is coupled to a shared node and said first collector is coupled to a reference node for conducting a reference current;

a second transistor which includes a second emitter, a second base and a second collector, wherein said second emitter is coupled to said shared node and said second base is coupled to said first transistor base;

a third transistor which includes a third emitter, a third base and a third collector, wherein said third emitter is coupled to said second transistor collector, said third base is coupled to said reference node and said third collector is for conducting a first output current; and a fourth transistor which includes a fourth emitter, a fourth base and a fourth collector, wherein said fourth emitter is coupled to said second transistor base, said fourth base is coupled to said reference node and said fourth collector is for conducting a second output current;

wherein a sum of said first and second output currents is selectively proportional to said reference current.

2. A current mirror circuit as recited in claim 1, wherein said shared node comprises a circuit power supply node.

3. A current mirror circuit as recited in claim 1, wherein said shared node comprises a circuit reference node.

4. A current mirror circuit as recited in claim 1, further comprising current converter means, coupled to said third and fourth transistor collectors, for receiving said first and second output currents and providing a load current which is selectively proportional to said sum of said first and second output currents.

5. A current mirror circuit as recited in claim 4, wherein said current converter means comprises a node for receiving said first and second output currents and providing said load current.

6. A current mirror circuit as recited in claim 4, wherein said current converter means comprises first and second current buffers for receiving said first and second output currents, respectively, and providing said load current.

7. A current mirror circuit as recited in claim 4, wherein said current converter means comprises first and second current scalers for receiving and scaling said first and second output currents by first and second scaling factors, respectively, to provide said load current.

8. A current mirror circuit as recited in claim 1, further comprising current converter means, coupled to said third and fourth transistor collectors, for receiving a load current which is selectively proportional to said sum of said first and second output currents, and providing said first and second output currents.

9. A current mirror circuit as recited in claim 8, wherein said current converter means comprises a node for receiving said load current and providing said first and second output currents.

10. A current mirror circuit as recited in claim 8, wherein said current converter means comprises first and second current buffers for receiving said load current and providing said first and second output currents, respectively.

11. A current mirror circuit as recited in claim 8, wherein said current converter means comprises first and second current scalers for receiving and scaling said load current by first and second scaling factors to provide said first and second output currents, respectively.

12. A current mirror circuit for conducting a reference current and in accordance therewith conducting an output current proportional thereto, comprising:

a first transistor which includes a first emitter, a first base and a first collector, wherein said first emitter is coupled to a shared node and said first collector is coupled to a reference node for conducting a reference current;

a second transistor which includes a second emitter, a second base and a second collector, wherein said second emitter is coupled to said shared node and said second base is coupled to said first transistor base; and a third transistor which includes third and fourth emitters, a third base and a third collector, wherein said third emitter is coupled to said second transistor collector, said fourth emitter is coupled to said second transistor base, said third base is coupled to said reference node and said third collector is for conducting an output current which is selectively proportional to said reference current.

13. A current mirror circuit as recited in claim 12, wherein said shared node comprises a circuit power supply node.

14. A current mirror circuit as recited in claim 12, wherein said shared node comprises a circuit reference node.

15. A current mirror circuit for conducting a reference current and in accordance therewith conducting a plurality of load currents, comprising:

an input transistor which includes an input emitter, an input base and an input collector, wherein said input emitter is coupled to a shared node and said input collector is coupled to a reference node for conducting a reference current; and a first output device group for conducting a first load current which is selectively proportional to said reference current, wherein said first output device group includes:

a first output transistor which includes a first output emitter, a first output base and a first output collector, wherein said first output emitter is coupled to said shared node and said first output base is coupled to said input transistor base;

a second output transistor which includes a second output emitter, a second output base and a second output collector, wherein said second output emitter is coupled to said first output transistor collector, said second output base is coupled to said reference node and said second output collector is for conducting an output current; and a third output transistor which includes a third output emitter, a third output base and a third output collector, wherein said third output emitter is coupled to said first output transistor base, said third output base is coupled to said reference node and said third output collector is for conducting a compensation current;

wherein a sum of said compensation current and said output current provides said first load current; and a second output device group for conducting a second load current which is approximately proportional to said reference current, wherein said second output device group includes:

a fourth output transistor which includes a fourth output emitter, a fourth output base and a fourth output collector, wherein said fourth output emitter is coupled to said shared node and said fourth output base is coupled to said input transistor base; and a fifth output transistor which includes a fifth output emitter, a fifth output base and a fifth output collector, wherein said fifth output emitter is coupled to said fourth output transistor collector, said fifth output base is coupled to said reference node and said fifth output collector is for conducting said second load current.

16. A current mirror circuit as recited in claim 15, wherein said shared node comprises a circuit power supply node.

17. A current mirror circuit as recited in claim 15, wherein said shared node comprises a circuit reference node.

18. A current mirror circuit as recited in claim 15, wherein said first output device group further includes current converter means, coupled to said second and third output transistor collectors, for receiving said compensation current and said output current and providing said first load current.

19. A current mirror circuit as recited in claim 18, wherein said current converter means comprises a node for receiving said compensation current and said output current and providing said first load current.

20. A current mirror circuit as recited in claim 18, wherein said current converter means comprises a plurality of current buffers for receiving said compensation current and said output current and providing said first load current.

21. A current mirror circuit as recited in claim 18, wherein said current converter means comprises a plurality of current scalers for receiving and scaling said compensation current and said output current by a plurality of scaling factors to provide said first load current.

22. A current mirror circuit as recited in claim 15, wherein said first output device group further includes current converter means, coupled to said second and third output transistor collectors, for receiving said first load current and providing said compensation current and said output current.

23. A current mirror circuit as recited in claim 22, wherein said current converter means comprises a node for receiving said first load current and providing said compensation current and said output current.

24. A current mirror circuit as recited in claim 22, wherein said current converter means comprises a plurality of current buffers for receiving said first load current and providing said compensation current and said output current.

25. A current mirror circuit as recited in claim 22, wherein said current converter means comprises a plurality of current scalers for receiving and scaling said first load current by a plurality of scaling factors to provide said compensation current and said output current.

26. A current mirror circuit for conducting a reference current and in accordance therewith conducting a plurality of load currents, comprising:

an input transistor which includes an input emitter, an input base and an input collector, wherein said input emitter is coupled to a shared node and said input collector is coupled to a reference node for conducting a reference current; and a first output device group for conducting a first load current which is selectively proportional to said reference current, wherein said first output device group includes:

a first output transistor which includes a first output emitter, a first output base and a first output collector, wherein said first output emitter is coupled to said shared node and said first output base is coupled to said input transistor base; and a second output transistor which includes second and third output emitters, a second output base and a second output collector, wherein said second output emitter is coupled to said first output transistor collector, said third output emitter is coupled to said first output transistor base, said second output base is coupled to said reference node and said second output collector is for conducting an output current;

wherein said output current provides said first load current; and a second output device group for conducting a second load current which is approximately proportional to said reference current, wherein said second output device group includes:

a third output transistor which includes a fourth output emitter, a third output base and a third output collector, wherein said fourth output emitter is coupled to said shared node and said third output base is coupled to said input transistor base; and a fourth output transistor which includes a fifth output emitter, a fourth output base and a fourth output collector, wherein said fifth output emitter is coupled to said third output transistor collector, said fourth output base is coupled to said reference node and said fourth output collector is for conducting said second load current.

27. A current mirror circuit as recited in claim 26, wherein said shared node comprises a circuit power supply node.

28. A current mirror circuit as recited in claim 26, wherein said shared node comprises a circuit reference node.

* * * * *